US007670191B2

(12) United States Patent
Ortega et al.

(10) Patent No.: US 7,670,191 B2
(45) Date of Patent: Mar. 2, 2010

(54) EXTENSION/EXPANSION TO UNIVERSAL SERIAL BUS CONNECTOR

(75) Inventors: Joseph Ortega, Camp Hill, PA (US); James M. Sabo, Harrisburg, PA (US); Kuan-Yu Chen, Harrisburg, PA (US); Chong Yi, Mechanicsburg, PA (US); Gary E. Biddle, Carlisle, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 245 days.

(21) Appl. No.: 11/788,613

(22) Filed: Apr. 20, 2007

(65) Prior Publication Data

US 2008/0261448 A1 Oct. 23, 2008

(51) Int. Cl.
*H01R 24/00* (2006.01)

(52) U.S. Cl. ..... 439/660

(58) Field of Classification Search ..... 439/541.5, 439/607.01, 79, 607.4, 541, 557, 660, 108, 439/218, 638, 607.02
See application file for complete search history.

(56) References Cited

U.S. PATENT DOCUMENTS 6,238,244 B1 * 5/2001 Yang ..... 439/607.01
6,296,521 B1 * 10/2001 Chang et al. ..... 439/607.4
6,939,168 B2 * 9/2005 Oleynick et al. ..... 439/541.5
7,021,971 B2 4/2006 Chou et al.
7,104,848 B1 9/2006 Chou et al.
7,108,560 B1 9/2006 Chou et al.
7,125,287 B1 10/2006 Chou et al.
7,134,884 B2 11/2006 Wang et al.
2006/0025015 A1 2/2006 Hu et al.
2006/0084827 A1 4/2006 Miller et al.
2006/0261474 A1 11/2006 Jiang et al.
2006/0286865 A1 12/2006 Chou et al.
2006/0294272 A1 12/2006 Chou et al.

* cited by examiner

*Primary Examiner*—Edwin A. Leon
(74) *Attorney, Agent, or Firm*—Wei Te Chung; Andrew C. Cheng; Ming Chieh Chang

(57) ABSTRACT

An extension to USB includes an insulative tongue portion and a number of contacts held in the insulative tongue portion. The contacts have four conductive contacts and two pairs of differential contacts for transferring differential signals. The four conductive contacts consist of a power contact, a ground contact, a – data contact and a + data contact. One pair of the differential contacts is located between the power contact and the – data contact and the other pair of the differential contacts is located between the power contact and the + data contact. The four conductive contacts are for USB protocol and arrangement of the four conductive contacts with the insulative tongue portion is compatible to the standard USB connector. The two pairs of differential contacts are for non-USB protocol. The extension to USB is capable of mated with a commentary standard USB connector and a commentary extension to USB, alternatively.

26 Claims, 23 Drawing Sheets

EXTENSION/EXPANSION TO UNIVERSAL SERIAL BUS CONNECTOR

BACKGROUND OF THE INVENTION

1. Field of the Invention

The present invention relates to electrical connectors, more particularly to electrical connectors compatible to standard Universal Serial Bus connectors.

2. Description of Related Art

Recently, personal computers used a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standards body incorporating leading companies from the computer and electronics industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification is at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-speed devices typically only operate at half of the full theoretical (60 MB/s) data throughput rate. Most hi-speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of high-speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

FIGS. 22 and 23 show existing USB connectors. In FIG. 22, this USB connector 500 is an existing USB plug, male connector. In application, the USB plug 500 may be mounted on a board in the peripherals, or may be connected to wires of a cable 57 as shown in FIG. 22. Generally, an insulative outer housing 55 always be mold over a rear end of the USB plug 500 and the cable 57 to secure the USB plug, the cable 57 and the insulative outer housing 55 together. The USB plug 500 can also be mounted in an opening in a plastic case of a peripheral, like a portable memory device. The USB plug 500 represents a type-A USB connector. The USB plug 500 includes an insulative plug tongue portion 52 formed of an insulating material, four conductive contacts 53 formed on the insulative plug tongue portion 52 and an metal shell 54 shielding the conductive contacts 53 and the insulative plug tongue portion 52. The metal shell 54 touches the insulative plug tongue portion 52 on three of the sides of the plug tongue portion 52. The conductive contacts 53 are supported on a top side of the plug tongue portion 52. A receiving cavity 56 is formed between the top side of the plug tongue portion 52 and a top of the metal shell 54, to receive a corresponding insulative receptacle tongue portion 62 shown in FIG. 23. The conductive contacts 53 carry the USB signals generated or received by a controller chip in the peripherals.

USB signals typically include power, ground, and serial differential data D+, D−. To facilitate discussion, the four conductive contacts 53 are designated with numeral 531, 532, 533 and 534 in turn. In application, the four conductive contacts 53 used to transfer power (531), D+ (532), D− (533) and ground (534) signals, respectively. The two central conductive contacts 532, 533 are used to transfer/receive data to/from the peripheral device or a host device. The four conductive contacts 53 can be formed of metal sheet in a manner being stamped out therefrom to four separated ones or formed as conductive pads on a printed circuit board (not shown) supported on the top side of the plug tongue portion 52.

FIG. 23 shows an existing USB receptacle 600, a female USB connector. The USB receptacle 600 commonly is an integral part of a host or PC. The USB receptacle 600 also presents a type-A USB connector. The USB receptacle 600 includes the insulative receptacle tongue portion 62 formed of an insulating material, four conductive contacts 63 held on the insulative receptacle tongue portion 62 and a metal shell 64 shielding the conductive contacts 63 and the insulative receptacle tongue portion 62. The conductive contacts 63 are supported on a bottom side of the insulative receptacle tongue portion 62. Same to assignment of the four conductive contacts 53 of the USB plug, assignment of the four conductive contacts 63 of the USB receptacle is contact 631 for power signal, contact 632 for D− signal, contact 633 for D+ signal and contact 634 for GND. Another receiving cavity 66 is formed between the bottom side of the insulative receptacle tongue portion 62 and a bottom of the metal shell 64. In application, the USB plug 500 in the peripheral device is inserted into the USB receptacle 600 mounted in the host or PC device. The plug tongue portion 52 is received in the receiving cavity 66 of the USB receptacle 600 and the receptacle tongue portion 62 is received in the receiving cavity 56 of the USB plug 500. After full insertion of the USB plug 500, the conductive contacts 53 of the USB plug 500 make a physical and electrical connection with the conductive contacts 63 of the USB receptacle 600 to transmit/receive signal to/from the host device to the peripheral device.

As discussed above, the existing USB connectors have a small size but low transmission rate, while other non-USB connectors (PCI Express, SATA, et al) have a high transmission rate but large size. Neither of them is desirable to implement modem high-speed, miniaturized electronic devices and peripherals. To provide a kind of connector with a small size and a high transmission rate for portability and high data transmitting efficiency is much desirable. Such kind electrical connectors are disclosed in an U.S. Pat. No. 7,021,971 (hereinafter 971 patent) issued on Apr. 4, 2006. Detailed description about these connectors is made below.

From the FIGS. 4A-6H and detailed description of 971 patent, we can find that the invention material of 971 patent is to extend the length of the plug and receptacle tongue portions of the existing USB connectors and to extend depth of the receiving cavity of the existing USB connectors, thereby to accommodate additional contacts in extended areas as shown in FIGS. 4A-5H of 971 patent; or to provide the additional contacts on a reverse-side of the plug tongue portion and accordingly with regard to receptacle, to provide a lower tongue portion under a top receptacle tongue portion thereby four USB contacts are hold on the top tongue portion and additional contacts are accommodated on the lower tongue portion of the receptacle. With contrast with existing USB A type receptacle, the receptacle with top and lower tongue portion is higher in height than existing USB receptacle.

As shown in FIGS. 4C, 4D, 5C, 5D and 6C, 6D of the 971 patent, number of the additional contacts is eight. The eight additional contacts plus the four USB contacts are used collectively or in-collectively for PCI-Express, SATA or IEEE 1394 protocol as required. To make the extended-USB plug and receptacle capable of transmitting PCI-Express or SATA or IEEE 1394 signals is the main object of the 971 patent. To achieve this object, at least eight contacts need to be added. Adding eight contacts in existing USB connector is not easy. May be, only embodiments shown in 971 patent is viable options to added so many contacts. As fully discussed above, the receptacle equipped with two tongue portions or plug and receptacle both with a longer length are also clumsiness. That is not very perfect from a portable and small size standpoint.

BRIEF SUMMARY OF THE INVENTION

An extension/expansion to USB compatible with standard USB comprises an insulative tongue portion defining a supporting side and a front-to-rear direction, a plurality of contacts held in the supporting side. The contacts comprise four conductive contacts and two pairs of differential contacts for transferring differential signals. The four conductive contacts consist of a power contact, a ground contact, a – data contact and a + data contact. One pair of the differential contacts is located between the power contact and the – data contact and the other pair of the differential contacts is located between the power contact and the + data contact. The four conductive contacts are for USB protocol and arrangement of the four conductive contacts with the insulative tongue portion is compatible to the standard USB connector. The two pairs of differential contacts are for non-USB protocol.

The two pairs of differential contacts for the non-USB protocol provide a high data transmission rate. Meanwhile, as compatible back to standard USB, the extension can be used in all the host device and peripheral equipped with at least a standard USB interface. One pair of differential contacts is located between the power contact and the – data contact and the other pair of differential contacts is located between the + data contact and the ground contact. With such arrangement, the extension to USB is with an ease structure and is portable. Furthermore, as the two pairs of differential contacts is used for an non-USB protocol, now, the extension to USB plug also can applied in other electronic device supporting the non-USB protocol.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
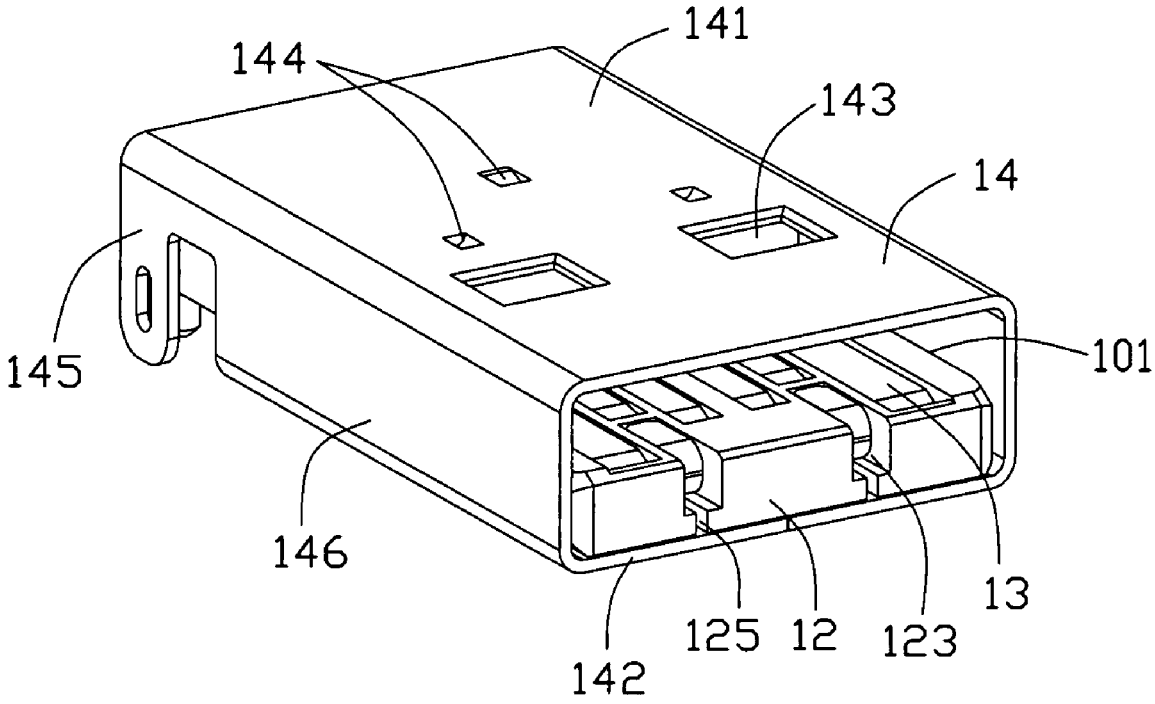
FIG. 1 is a perspective view of an extension to USB plug according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, receptacle, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host computer and a wide range of simultaneously accessible peripherals. The bus allows peripherals to be attached, configured, used, and detached while the host and other peripherals are in operation. This is referred to as hot plugged.

Referring to FIGS. 1-5, an extension to USB plug 100 according to a first embodiment of the present invention is disclosed. The extension to USB plug 100 includes an insulative base portion 11, an insulative tongue portion 12 extending forwardly from insulative base portion 11 the in a front-to-rear direction, a plurality of contacts 13 supported in the insulative tongue portion 12 and a metal shell 14 shielding the insulative base portion 11, the insulative tongue portion 12 and the contacts 13. In below description of an extension to USB receptacle 200 (shown in FIGS. 6-10), same terminologies are, adopted to similar elements, the extension to USB receptacle 200 also includes an insulative base portion 21, an insulative tongue portion 22 extending forwardly from the insulative base portion 21 in the front-to-rear direction, a plurality of contacts 23 held in the insulative tongue portion 22 and a metal shell 24 shielding the insulative base portion 21, the insulative tongue portion 22 and the contacts 23. To facilitate description on them, we further name these elements of plug as plug base portion 11, plug tongue portion 12, plug contacts 13, plug metal shell 14; we also further name these elements of receptacle as receptacle base portion 21, receptacle tongue portion 22, receptacle contacts 23, receptacle metal shell 24. Detail description of these elements and their relationship and other elements formed thereon will be discussed below.

Referring to FIGS. 1-4, in this embodiment of the present invention, the plug base portion 11 and the plug tongue portion 12 are integrally injecting molded as an unit one piece, name as plug housing 10. The plug tongue portion 12 defines a supporting side 121 and a bottom side 122 opposite to the supporting side 121. The plug base portion 11 and tongue portion 12 both defines a front end 110, 120 and a rear end 112, 126 opposite to their front end 110, 120. The plug tongue portion 12 extending forwardly in the front-to-rear direction from the front end 110 of the plug base portion 11. In other words, the rear end 126 of the plug tongue portion 12 connects with the front end 110 of the plug base portion 11. The plug base portion 11 forms a plurality of projections 113, 116 on sides thereof. On a bottom side thereof, the projections 116 are in a manner of post for mounted into holes of a device the extension to USB plug 100 be mounted. A plurality of depressed portion 114 is formed on a top side of the plug base portion 11 for engagement with corresponding projections formed on the plug metal shell 14. A number of plug contact receiving passageways 123 are recessed in the supporting side 121 of the plug tongue portion 12. The plug contact receiving passageways 123 all extend from the plug tongue portion 12 toward the plug base portion 11 in the front-to-rear direction.

In this embodiment of the present invention, the plug contacts 13 includes four plug conductive contacts designated with numeral 131, 132, 133 and 134 and two pairs of differential plug contacts designated with numeral 135, 137 and 136, 138. These plug contacts 13 are received in the plug contact receiving passageways 123. The pair of differential plug contacts 135, 137 is located between the plug conductive contacts 131 and 132 without disturbing any one of the plug conductive contacts 131 and 132. The other pair of the differential plug contacts 136, 138 is located between the plug conductive contacts 133 and 134 without disturbing any one of the plug conductive contacts 133 and 134.

Figure 2:
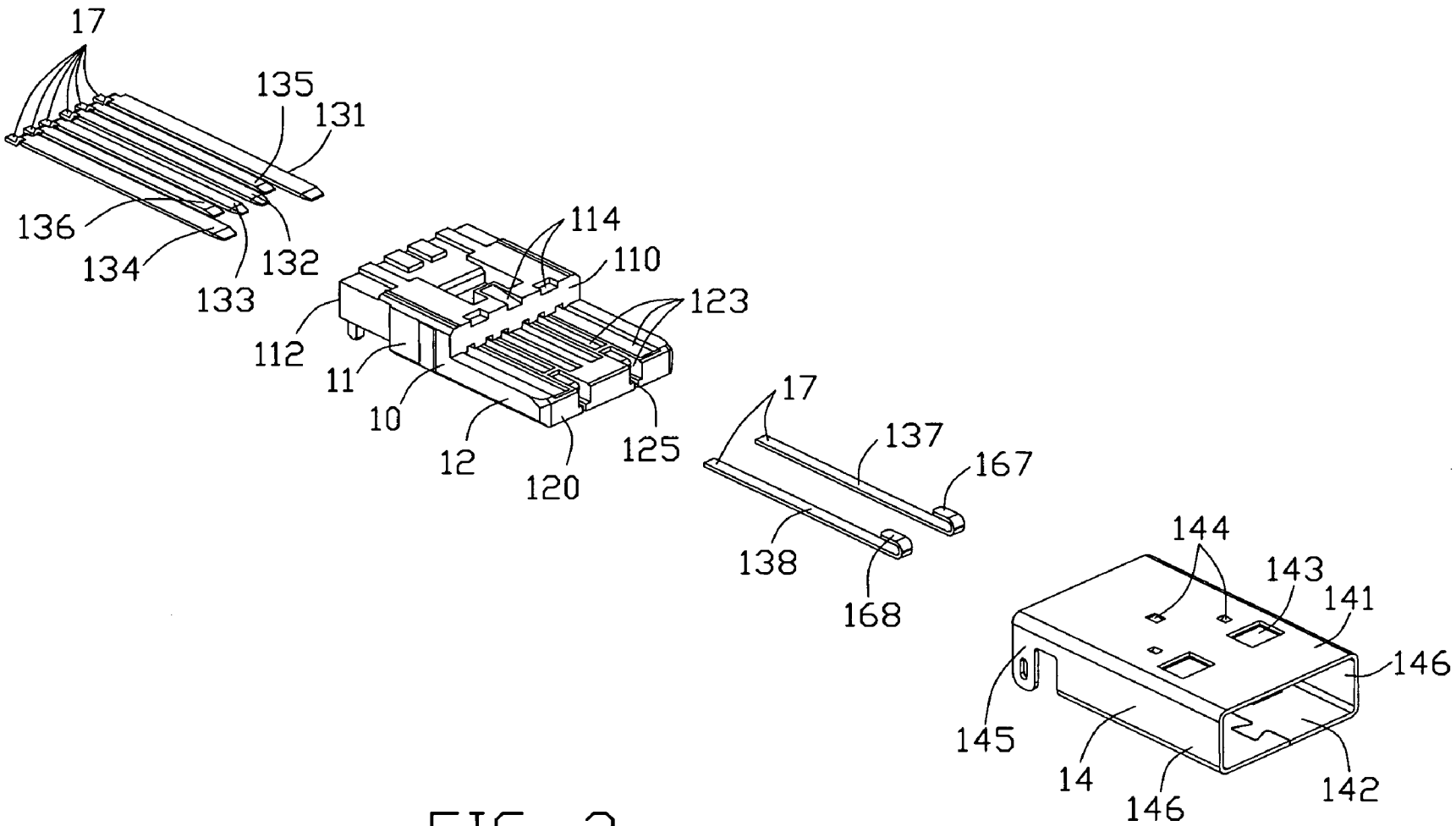
FIG. 2 is an exploded perspective view of the extension to USB plug shown in FIG. 1.
Figure 3:
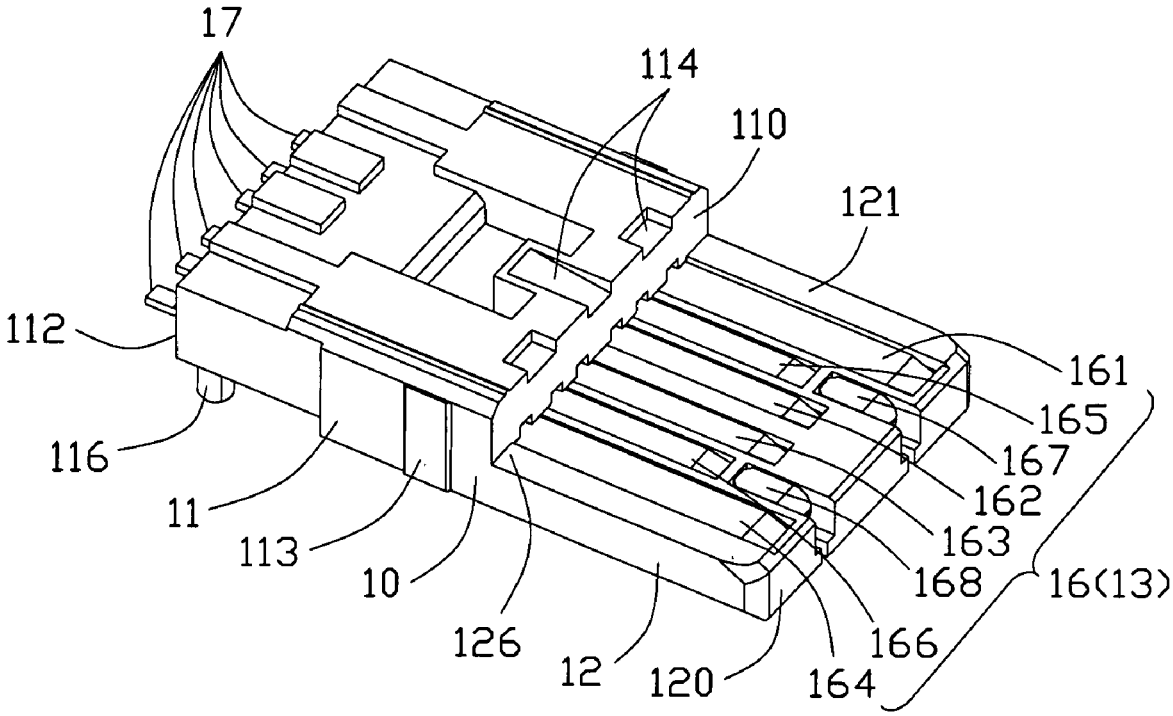
FIG. 3 is a perspective view of the extension to USB plug with a metal shell thereof removed therefrom.
Figure 4:
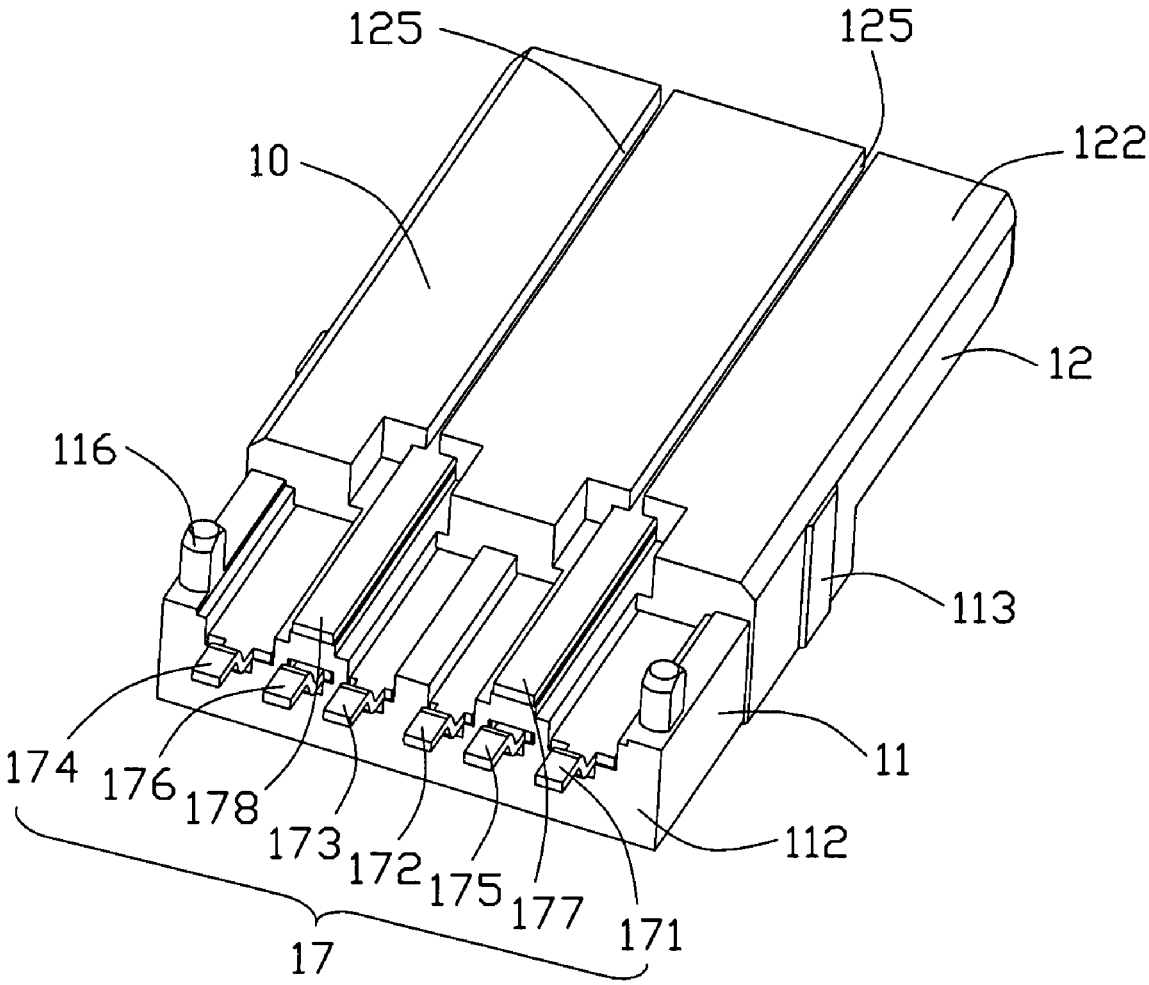
FIG. 4 is a view similar to FIG. 2, but taken from another aspect.
Figure 5:
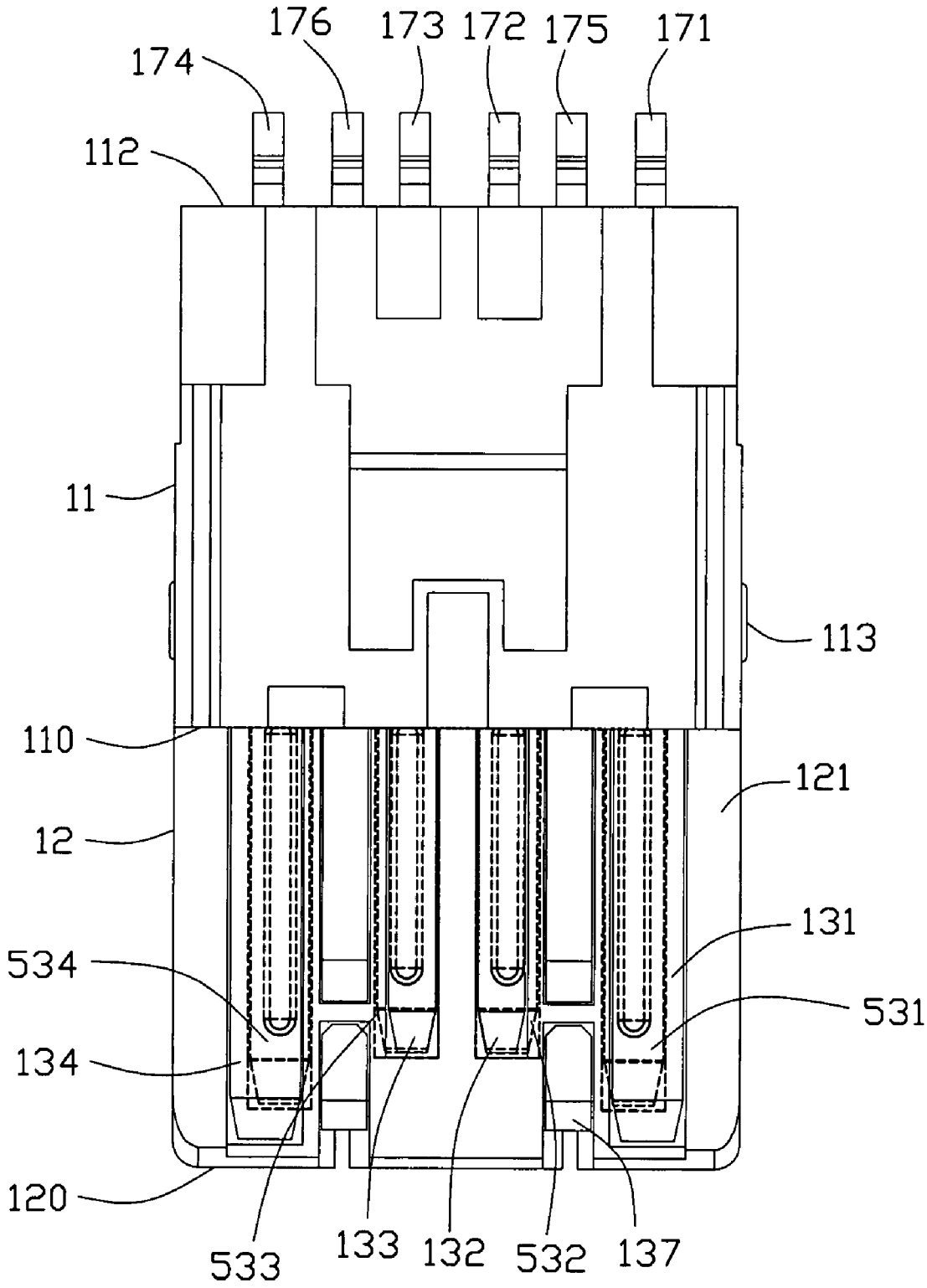
FIG. 5 is a top plane view of the extension to USB plug with its metal shell removed therefrom, showing contacts arrangement difference between the extension to USB plug and the standard USB plug.

As shown in FIGS. 2-4, each of the plug contacts 13 has a contacting portion 16 and a tail portion 17. The plug contacting portions 16 contact corresponding contacting portions of a complementary connector. The tail portion 17 is for connecting with electrical element, such as wires of cable similar to the, standard USB plug 500. In such case, the tail portions 17 are connected to wires of the cable and commonly an insulating housing is molded over the cable and a rear end of the plug metal shell 14 for grasping by a user. The contacting portions 16 of the four plug conductive contacts 131, 132, 133 and 134 and the two pairs of differential plug contacts 135, 137 and 136, 138 are designated respectively with numeral 161, 162, 163, 164 and 165, 167 and 166, 168. Also, the tail portions 17 of the four plug conductive contacts 131, 132, 133 and 134 and the two pairs of differential plug contacts 135, 137 and 136, 138 are designated respectively with numeral 171, 172, 173, 174 and 175, 177 and 176, 178. As clearly shown in FIG. 2, the differential contacts 137 and 138 are in a same bent shape. The contacting portion 167 of the differential plug contacts 137 parallel with and located above its tail portions 177. Under this case, the differential plug contacts 137 and 138 are inserted into its receiving passageways 123 from the front end of 120 of the plug tongue portion, while other plug contacts 131, 132, 133, 134 and 135, 136 are all inserted from the rear end 112 of the plug base portion 11. The contacting portions 16 are all supported on the supporting side 121 of the plug tongue portion 12. The bottom side 122 of the plug tongue portion 12 further defines a pair of lengthwise slots 125 therein, as shown in FIGS. 2 and 4. The pair of slots 125 extends from the front end 120 to the plug base portion 11 and communicates with the contact receiving passageways 123 for differential plug contacts 137 and 138 to expose the different plug contacts 137 and 138 to exterior. On other hand, to provide the pair of slots 125 enhances a strength of a mold pin for inject molding the contact receiving passageways 123 of the different plug contacts 137 and 138 in the manufacture process.

The pair of differential plug contacts 135 and 137 are arranged in a line in the front-to-rear direction within an allowable tolerance. The contacting portions 165 and 167 are separated in the front-to-rear direction with no portion of them contact each other. Arrangement of the other pair of differential plug contacts 136 and 138 is same to what of the differential plug contacts 135 and 137. The tail portions 177 and 178 are in a plat shape supported by the plug base portion and without extending beyond the plug base portion as clearly shown in FIG. 4; other tail portions are all in bent shape and extending beyond the rear end 112 of the plug base portion 11. Furthermore, the tail portions 177 and 178 are in a different level in a height direction perpendicular to the front-to rear direction, with contrast with other tail portions of the plug contacts 13. With the arrangement discussed above, the tail portions 177 and 178 are apart from other tail portions in the front-to-rear direction and the height direction to prevent electrical shorting.

Figure 22:
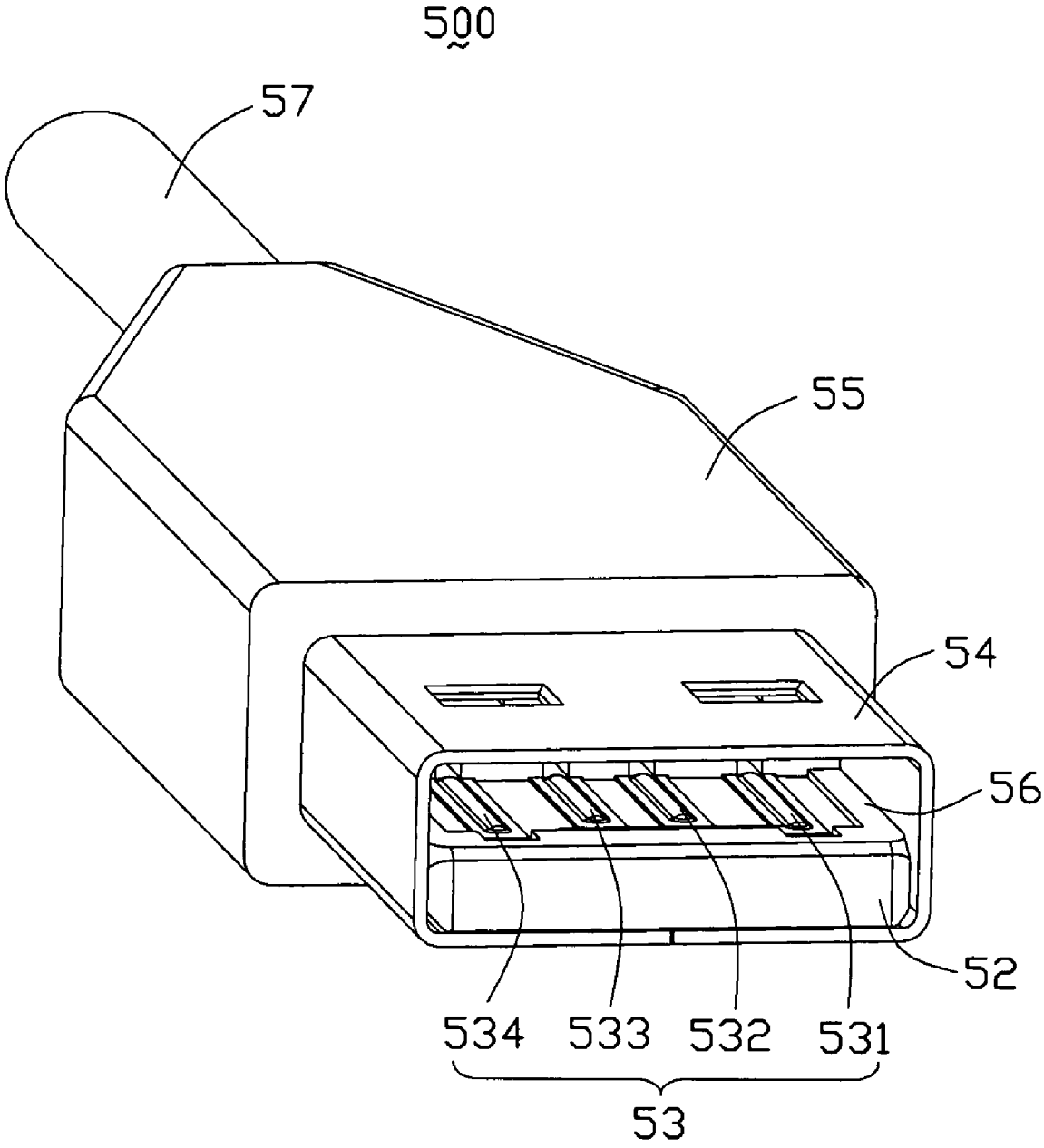
FIG. 22 (PRIOR ART)
FIG. 22 is a perspective schematic view of an standard USB plug connecting with a cable.

The extension to USB plug 100 is compatible to existing standard USB plug, such as the standard USB plug 500 in FIG. 22. An arrangement of the four plug conductive contacts 131, 132, 133 and 134 is compatible to what of the standard USB plug 500. The four plug conductive contacts are for USB protocol to transmit USB signals. The conductive contact 131, 132, 133 and 134 are for power (VBUS) signal, – data signal, + data signal and grounding, respectively. So now, from assignment of each plug conductive contacts standpoint, different terminology are given to each of the four plug conductive contacts 13, the conductive contacts 131, 132, 133 and 134 respectively named as power contact 131, – data contact 132, + data contact 133 and ground contact 134.

The geometric profile of the plug tongue portion 12 is same to what of the standard USB plug 500 within an allowable tolerance. That is, length, width and height of the plug tongue portion 12 are substantially equal to what of the standard USB plug 500. The supporting side 121 of the plug tongue portion 12 is a top side thereof. The supporting side 121 defines a center line (not labeled) extending in the front-to-rear direction. In comparison with the standard USB plug, as clearly shown in FIG. 5, pitches between the power contact 131 and the – data contact 132 and between the + data contact 133 and the ground contact 134 are both larger than what of the standard USB plug 500 to accommodate the two pairs of differential plug contacts 135, 137 and 136, 138 therebetween, respectively. In this embodiment, the power contact 131 and the ground contact 134 are both shifted outward with contrast to location of corresponding contacts 531 and 534 of the standard USB plug, that is to say, distances between the center line and power contact and between the center line and the ground contact are larger than what of the standard USB plug 500. To further make the pitches between the power contact 131 and the – data contact 132, and between the + data contact 133 and the ground contact 134 are both larger, width of the – data contact 132 and the + data contact 133 may be made narrower than what of the contacts 532 and 533 of the standard USB plug 500. In this embodiment, a pitch between the – data contact 132 and the + data contact 133 is substantially equal to what of the standard USB plug 500. In other words, in this specific embodiment, the – data contact 132 and the + data contact 133 only are made narrower but not shifted in comparison with corresponding contacts of the standard USB plug 500.

Regarding FIGS. 1 and 2, the plug metal shell 14 is in a tube shape, which defines a top side 141, a bottom side 142 opposite to the top side 141 and a pair of sidewalls 146 connecting the top side 141 and the bottom side 142. The plug metal shell 14 is mounted to the plug base portion 11 to enclose the plug base portion 11, the plug tongue portion 12 and the plug contacts 13 with a receiving cavity 101 formed between the supporting side 121 and the top side 141. The plug metal shell 14 touches other three sides of the plug tongue portion 12. The plug contacting portions 16 are all exposed to the receiving cavity 101 to contact corresponding contacting portions of a complementary connector. An arrangement of the plug metal shell 14 with the plug tongue portion 12 is also compatible with what of standard USB plug 500. Each of the top and bottom side 141, 142 is defined in a pair of through holes 143. The top side 141 also forms a plurality of projections 144 in a shape of tab projecting inwardly to engage with depressed portions 114 of the plug base portion 11. The projections 113 formed on the plug base portion engaged with sidewalls 146 of the plug metal shell 14. Thus, the plug metal shell 14 is secured on the plug base portion 11.

It is to be understood that, in other embodiments, locations of the four conductive contacts 131, 132, 133 and 134 can be in other arrangements under a condition that arrangement of the four conductive contacts are compatible to standard USB plug contact arrangement to transmitting USB signals and the two pairs of different contacts 135, 137, 136 and 138 can be located between the outer two contacts (the power contact 131 and the – data contact 132; the ground contact 134 and the + data contact 133 ) without disturb any portion of the four conductive contacts 131, 132, 133 and 134. For example, to have pitches between the outer two contacts (the power contact 131 and the – data contact 132; the ground contact 134 and the + data contact 133) both larger than what of the standard USB plug 500, some options can be selected. One option is that all of the four conductive contacts 131, 132, 133 and 134 are made narrower than corresponding contacts of the standard USB plug 500. Another option is to shift the two central contacts (the – data contact 132 and the + data contact 133) inwardly with or without narrowing the two outer contacts (the power contact 131 and the ground contact 134) in comparison with corresponding contacts of the standard USB plug 500.

In the first embodiment, the plug contacts 13 are all formed of a metal sheet and separated form each other. It is also to be understood that, in other embodiments, the plug contacts 13 can be conductive pads formed on a printed circuit board which is supported on the supporting side 121 of the plug tongue portion 12. These two options to make contacts are both viable in industry.

In FIG. 6-11, the extension to USB receptacle 200 is disclosed. In this embodiment, the extension to USB receptacle 200 is a stacked receptacle with two single receptacle, a top and a below one. Of course, a single one interface is easy to make under a principle similar to the stacked one. Now, detailed description on the extension to USB receptacle 200 is made below. The extension to USB receptacle 200 includes a receptacle housing 20, the receptacle contacts 23 received in the receptacle housing 10, the receptacle metal shell 24 enclosing the receptacle housing 20, a rear metal shell 28 enclosing a rear side of the receptacle housing 10 and another metal shell 29 enclosing a supporting plate 25 of the receptacle housing 10.

The receptacle housing 20 includes the receptacle base portion 21, two of the receptacle tongue portion 22 and the supporting plate 25 all extending integrally forwardly from a front end 210 of the receptacle base portion 21. The receptacle base portion 21, the receptacle tongue portions 22 and the supporting plate 25 are integrally injecting molded as one piece of the receptacle housing 20. The receptacle tongue portion 22 defines a supporting side 221 and a top side 222 opposite to the supporting side 221. The receptacle base portion 21 and tongue portion 22 both defines a front end 210, 220 and a rear end 212, 226 opposite to their front end 210, 120. The receptacle tongue portion 22 extends forwardly in the front-to-rear direction from the front end 210 of the receptacle base portion 11. In other words, the rear end 226 of the receptacle tongue portion connects with the front end 210 of the receptacle base portion 21. The receptacle base portion 21 forms a plurality of projections 213 on a pair of sidewalls 211 thereof and near the rear end 212. On a bottom side 215 of the receptacle base portion 21, a plurality of protrusions 216 protrude outward for standing on a board (not shown) that the extension to USB receptacle 200 be mounted on. A pair of depressed portion 214 is formed on the sidewalls 211 of the receptacle base portion 21 for engagement with corresponding projections formed on the receptacle metal shell 24. A number of receptacle contact receiving passageways 223 are recessed in the supporting side 221 of the receptacle tongue portion 22 to receive the receptacle contacts 23. The receptacle contact receiving passageways 223 all extend from the receptacle tongue portion 22 toward the receptacle base portion 21. The receptacle base portion 21 defines a rear room 203 for receiving part of the receptacle contacts 23. A pair of receiving slots 217 is defined in the receptacle base portion 21, which communicates with the rear room 203.

Arrangement of the receptacle contacts 23 in the two single receptacle are same, so now to describe the receptacle contacts 23 in one single receptacle is enough, for example, the top receptacle. In the top receptacle, the receptacle contacts 23 includes four receptacle conductive contacts designated with numeral 231, 232, 233 and 234 and two pairs of differential receptacle contacts designated with numeral 235, 237 and 236, 238 corresponding numerals of each of the plug contacts 13. These receptacle contacts 23 are received in the receptacle contact receiving passageways 223 that the receptacle contacts 23 are held in the supporting side 221 of the receptacle tongue portion 12. The pair of differential receptacle contacts 235, 237 is located between the receptacle conductive contacts 231 and 232 without disturbing any one of the receptacle conductive contacts 231 and 232. The other pair of the differential receptacle contacts 236, 238 is located between the receptacle conductive contacts 233 and 234 without disturbing any one of the receptacle conductive contacts 233 and 234.

Figure 8:
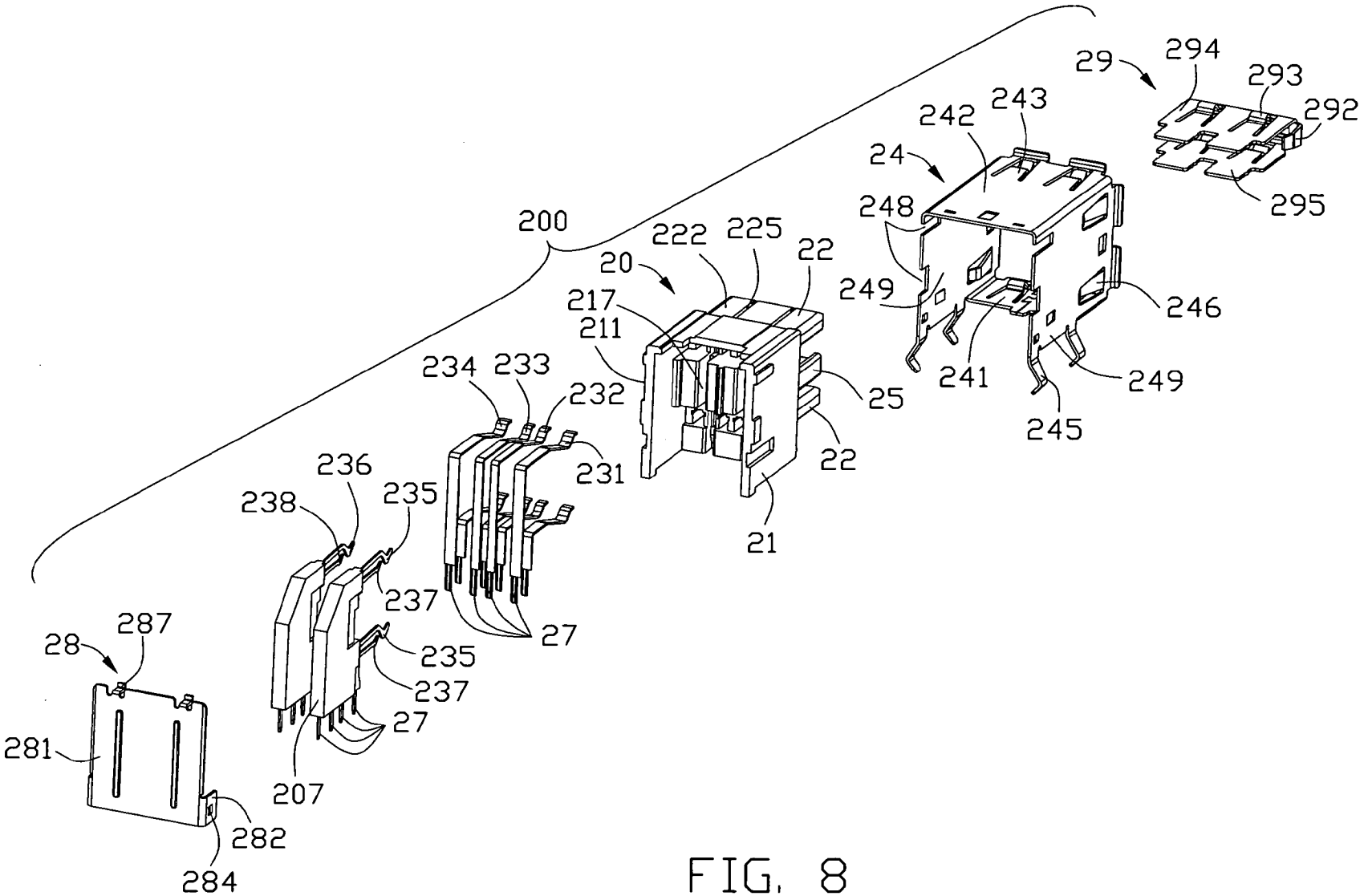
FIG. 8 another exploded perspective view of the extension to USB receptacle shown in FIG. 6, while taken from another aspect.
Figure 10:
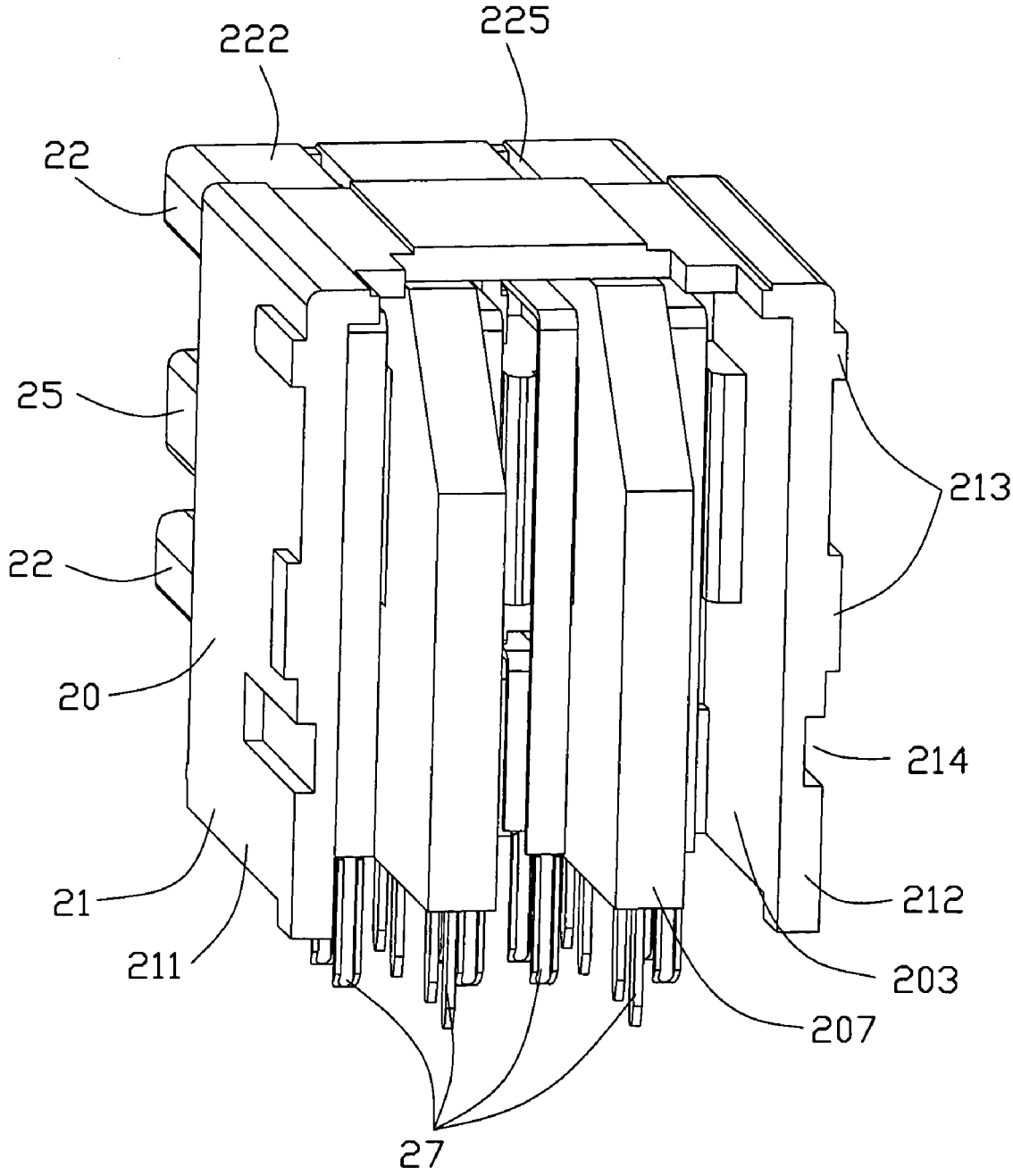
FIG. 10 is a view similar to FIG. 8, while viewed from another aspect.
Figure 11:
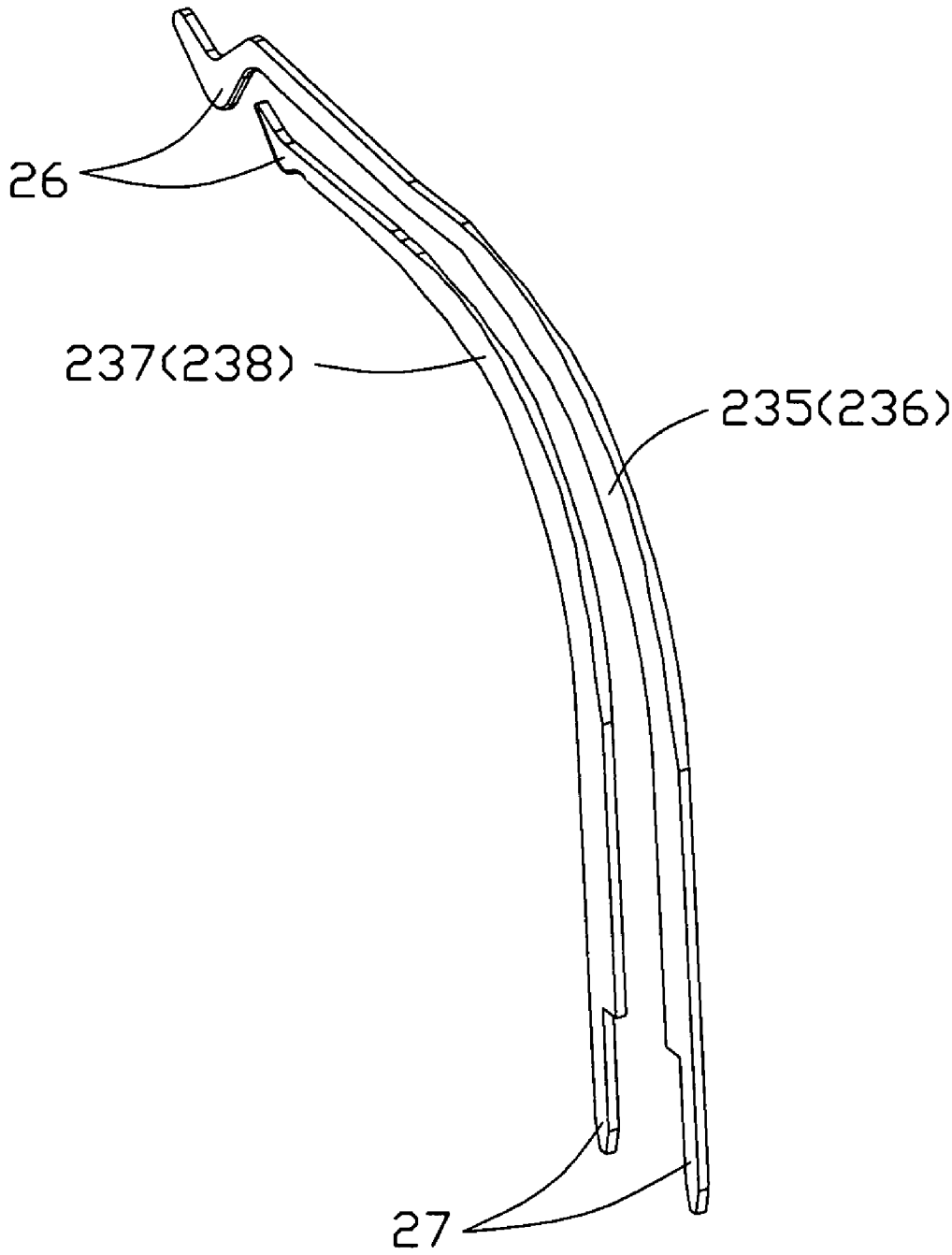
FIG. 11 is a perspective view of a pair of differential contacts of the extension to USB receptacle.
Figure 12:
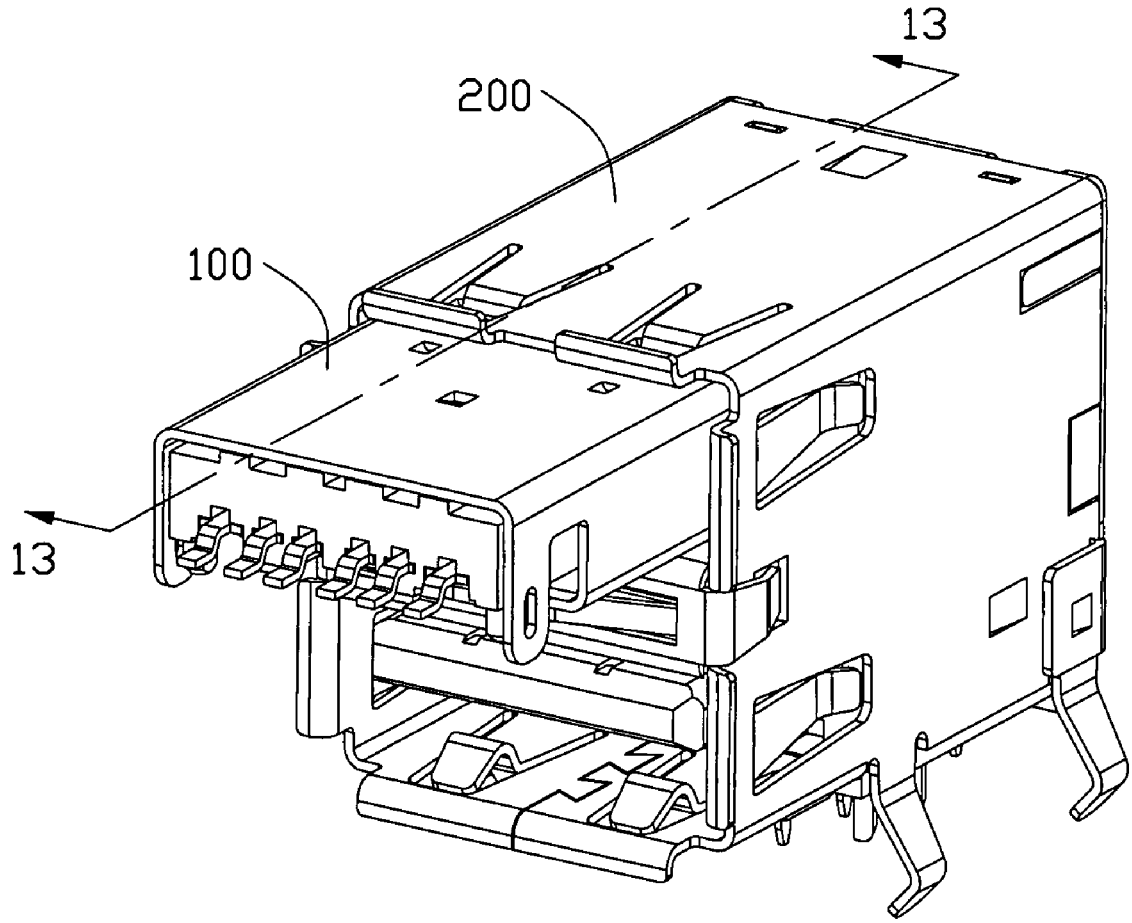
FIG. 12 is a perspective view of the extension to USB plug and receptacle, showing a state that the extension to USB plug is fully inserted into the extension to USB receptacle.
Figure 13:
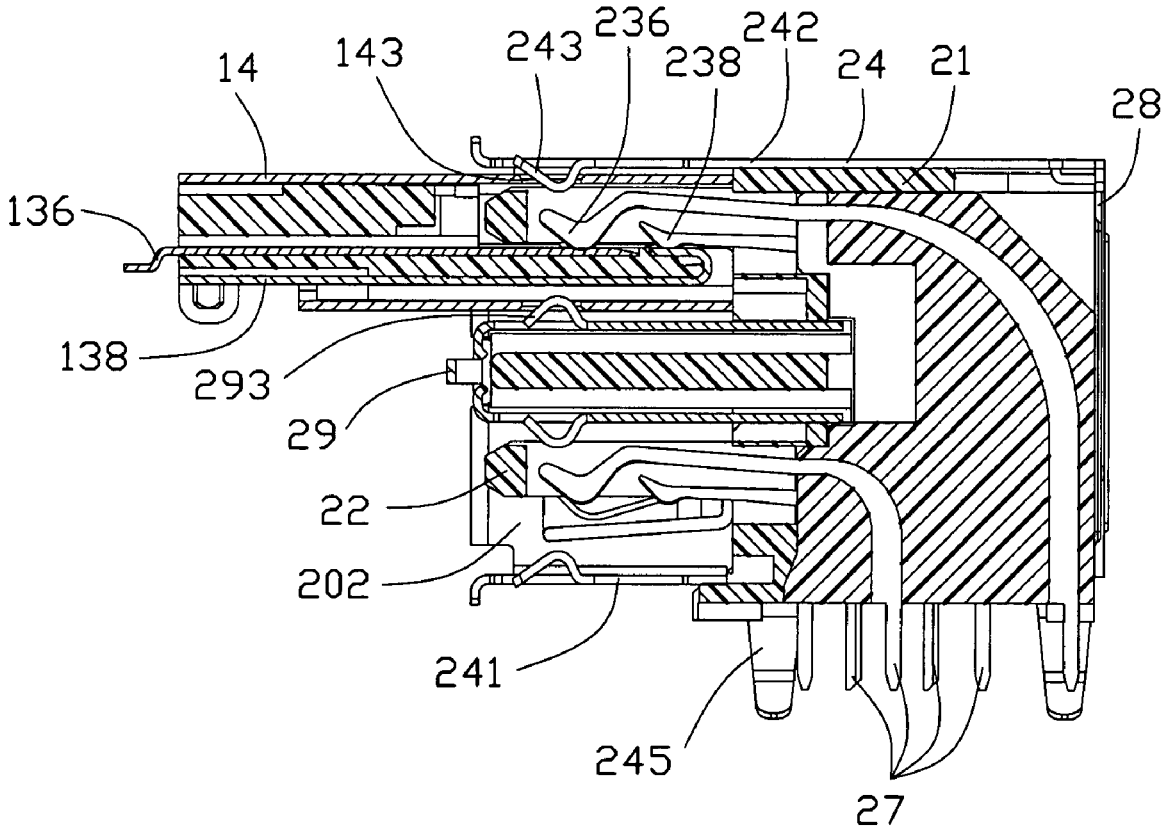
FIG. 13 is a cross-section view of the extension to USB plug and receptacle taken along line 13-13 of FIG. 12, showing the differential contacts of the extension to USB receptacle contacts corresponding differential contacts of the extension to USB plug.

The top side 222 of the receptacle tongue portion 22 further defines a pair of lengthwise slots 225 therein, as shown in FIGS. 8 and 10. One slot 225 extends from the front end 220 to the receptacle base portion 21 and communicates with the receptacle contact receiving passageways 223 of one pair of differential receptacle contacts 235 and 237 to expose the different receptacle contacts 235 and 237 to exterior. On other hand, to provide the pair of lengthwise slots 225 enhances strength of a mold pin for inject molding the receptacle contact receiving passageways 223 of the different receptacle contacts 235 and 237 in the manufacture process. Besides, the other slot 225 is in same arrangement, which communicates with receptacle contact receiving passageways 223 of the other differential receptacle contacts 236 and 238.

Figure 7:
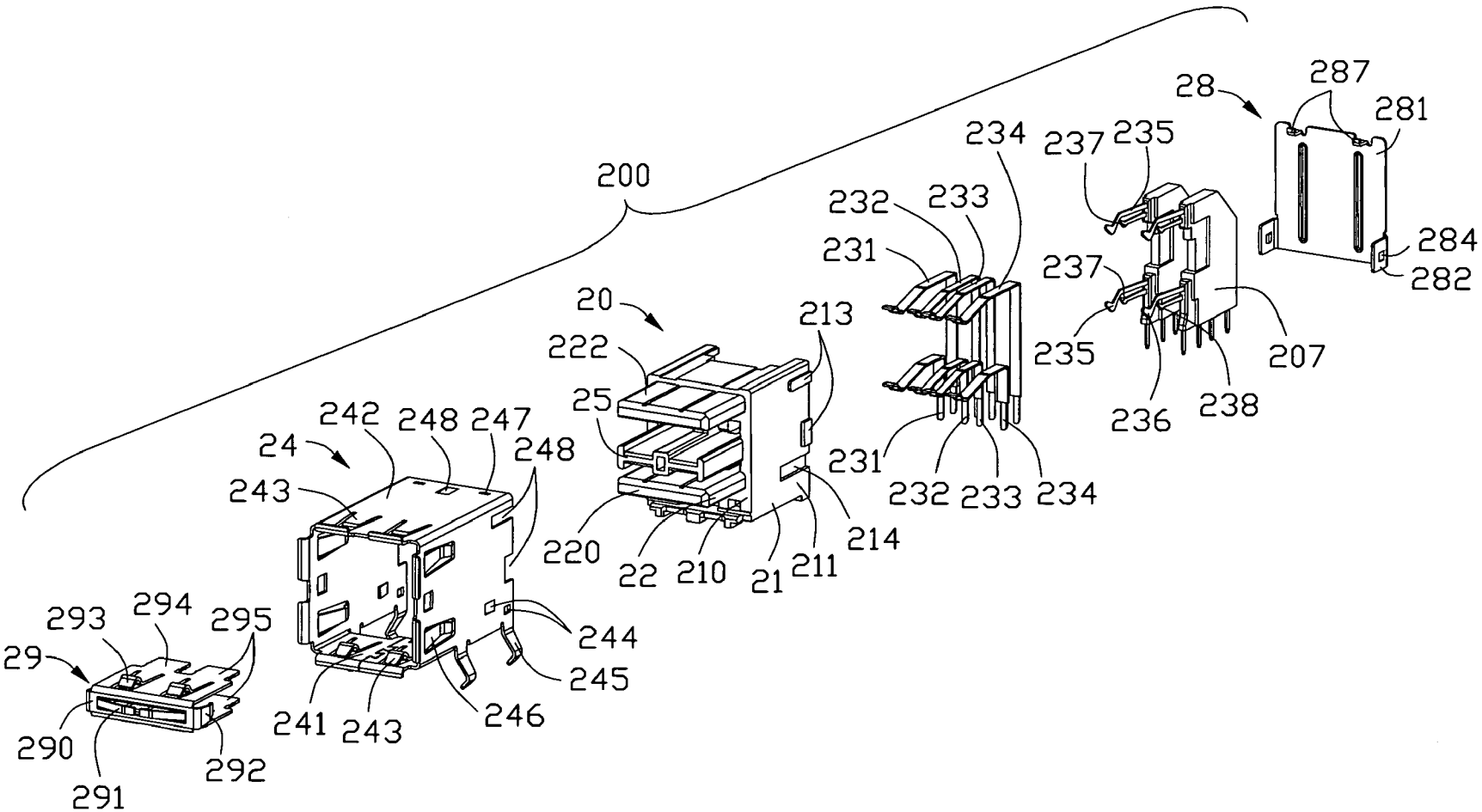
FIG. 7 is an exploded perspective view of the extension to USB receptacle shown in FIG. 6.
Figure 9:
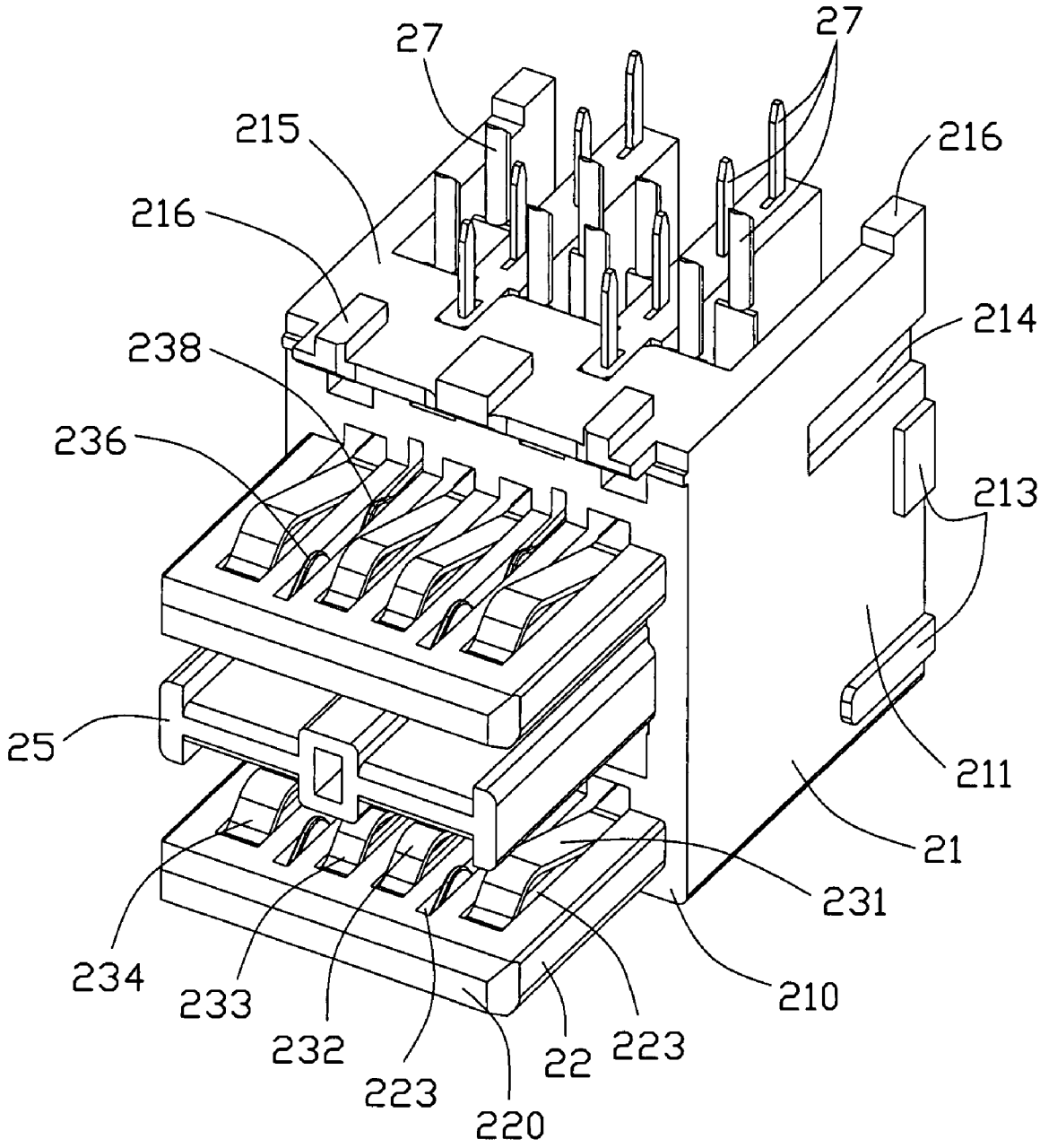
FIG. 9 is a perspective view of the extension to USB with a metal shell thereof removed therefrom.
Figure 14:
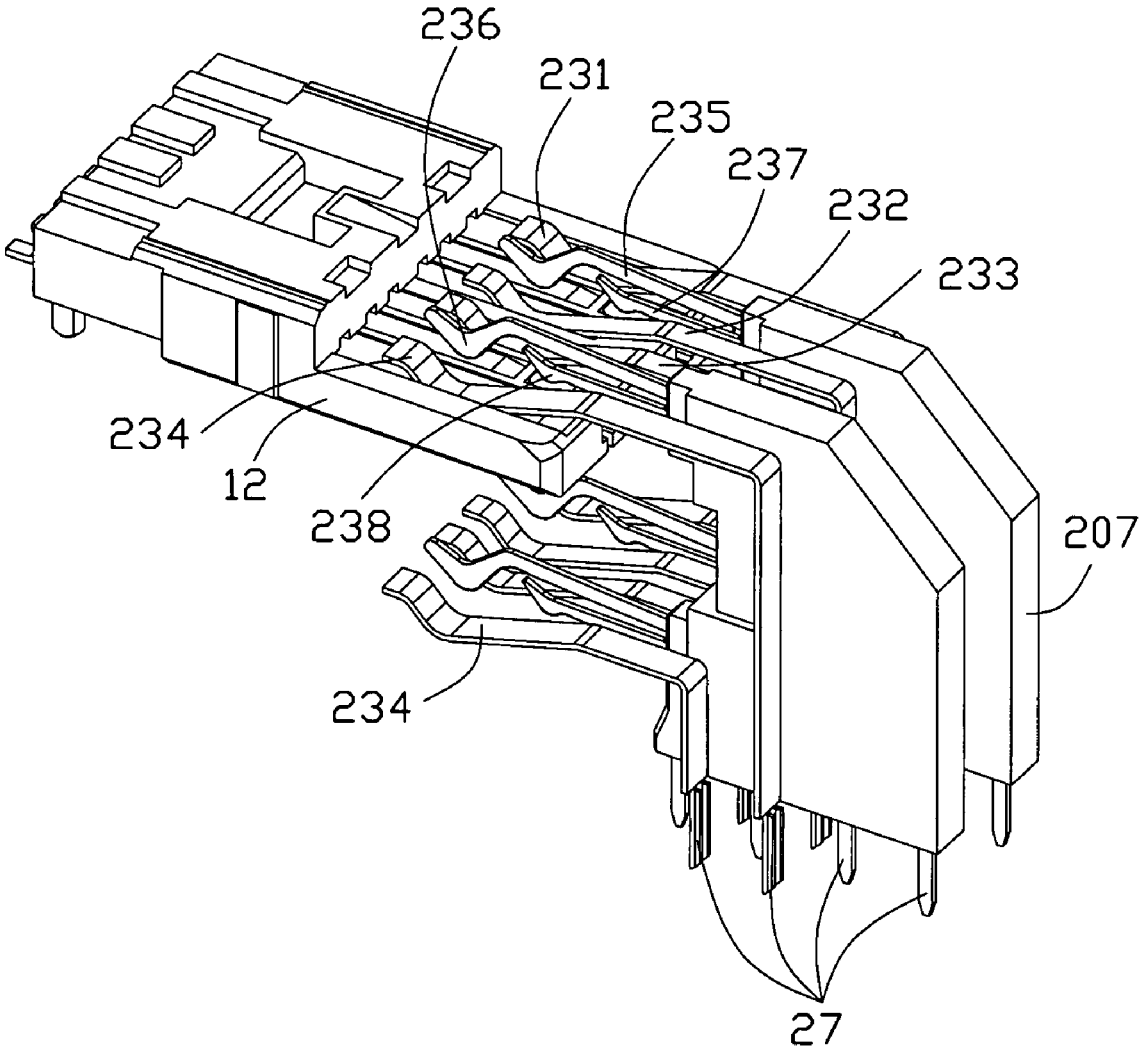
FIG. 14 is a perspective view of the extension to USB plug and receptacle in the mating status as shown in FIG. 12 with their metal shells taken off, illustrating mating relations of the contacts of the extension to USB plug and receptacle.
Figure 15:
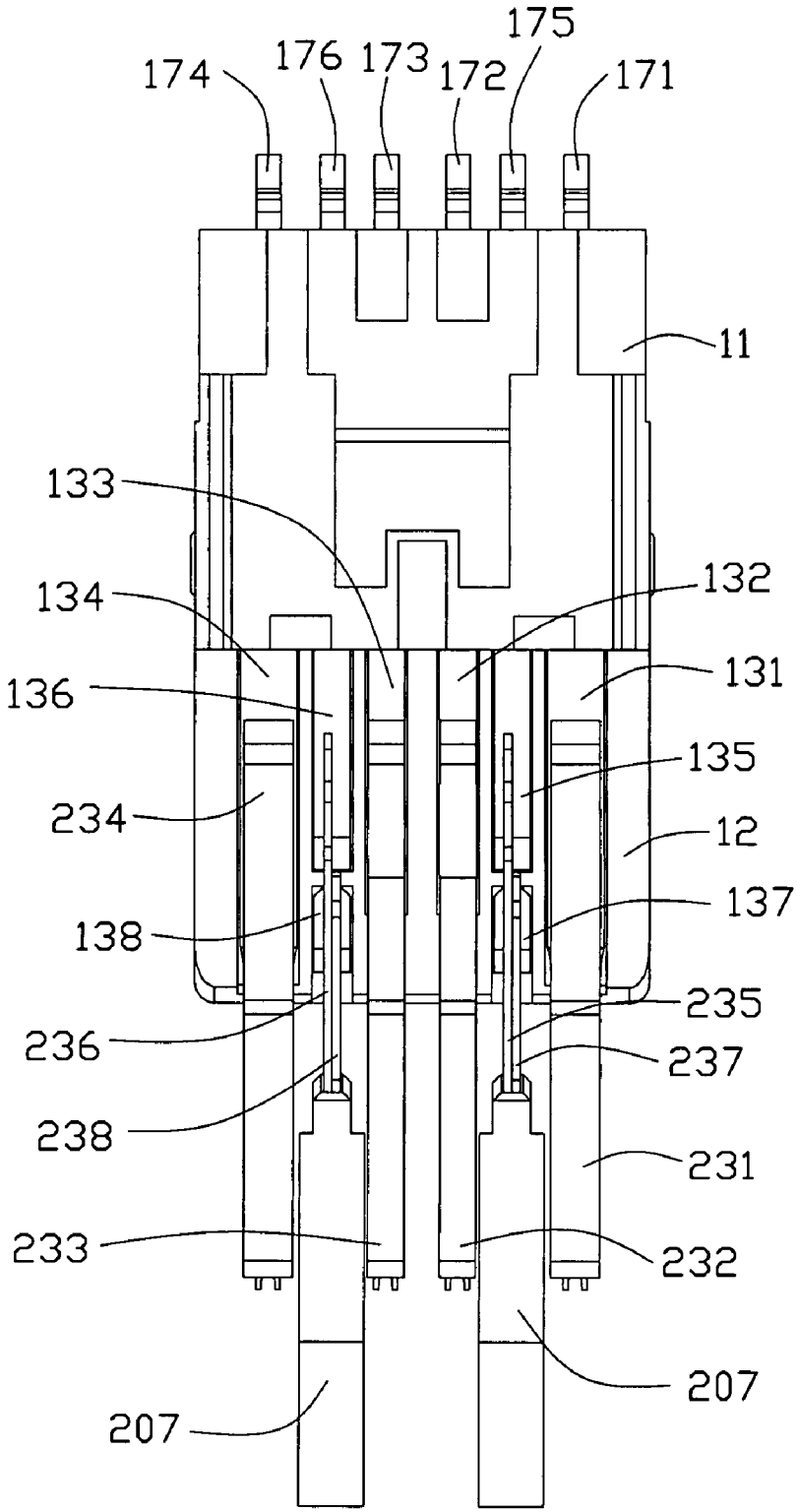
FIG. 15 is a top plane view of the extension to USB plug and receptacle in the mating status shown in FIG. 14, further illustrating the mating relations of the contacts of the extension to USB plug and receptacle.

As shown in FIGS. 7-9, each of the receptacle contacts 23 has a contacting portion 26 and a tail portion 27. The contacting portions 26 are all supported on the supporting side 221 of the receptacle tongue portion 22. The tail portions 27 all extending in a direction perpendicular to the bottom side 215 for electrical mounting into corresponding through holes defined in the board (not shown) that the extension to USB receptacle 200 be mounted on. The tail portions 27 of the four conductive contacts 231, 232, 233 and 234 are all in a semi-tube shape to increase strength thereof when mounted into corresponding through holes defined in the board. In conjunction with FIGS. 14-15, the pair of differential receptacle contacts 235, 237 offset form each other in the front-to-rear direction and a lateral direction perpendicular to the front-to-rear direction to provide a durable mating with corresponding differential plug contacts 135, 137. Arrangement of the other pair of receptacle contacts 236, 238 is same to what of the pair of differential receptacle contacts 235, 237. A pair of insulating element 207 is provide to mold over four pairs of the differential receptacle contacts (two pairs of the differential receptacle contacts 235, 237 and another two pairs of the differential receptacle contacts 236, 238) of the top and below receptacle with the contacting portions 26 and the tail portions 27 thereof outside the insulating element 207. One insulating element 207 is molded over two pairs of the differential receptacle contacts 235, 237 of the top and below receptacle; the other insulating element 207 is molded over two pairs of the differential receptacle contacts 236, 238 of the top and below receptacle. The pair of insulating elements are pressed into the receiving slots 217 of the receptacle base portion 21 from the rear end 212 thereof and partly accommodated in the rear room 203 with the tail portions 27 of the differential receptacle contacts 235, 237, 236 and 238 extending beyond the bottom side 215 and the contacting portions 26 extending to area of the receptacle tongue portion 22.

Figure 23:
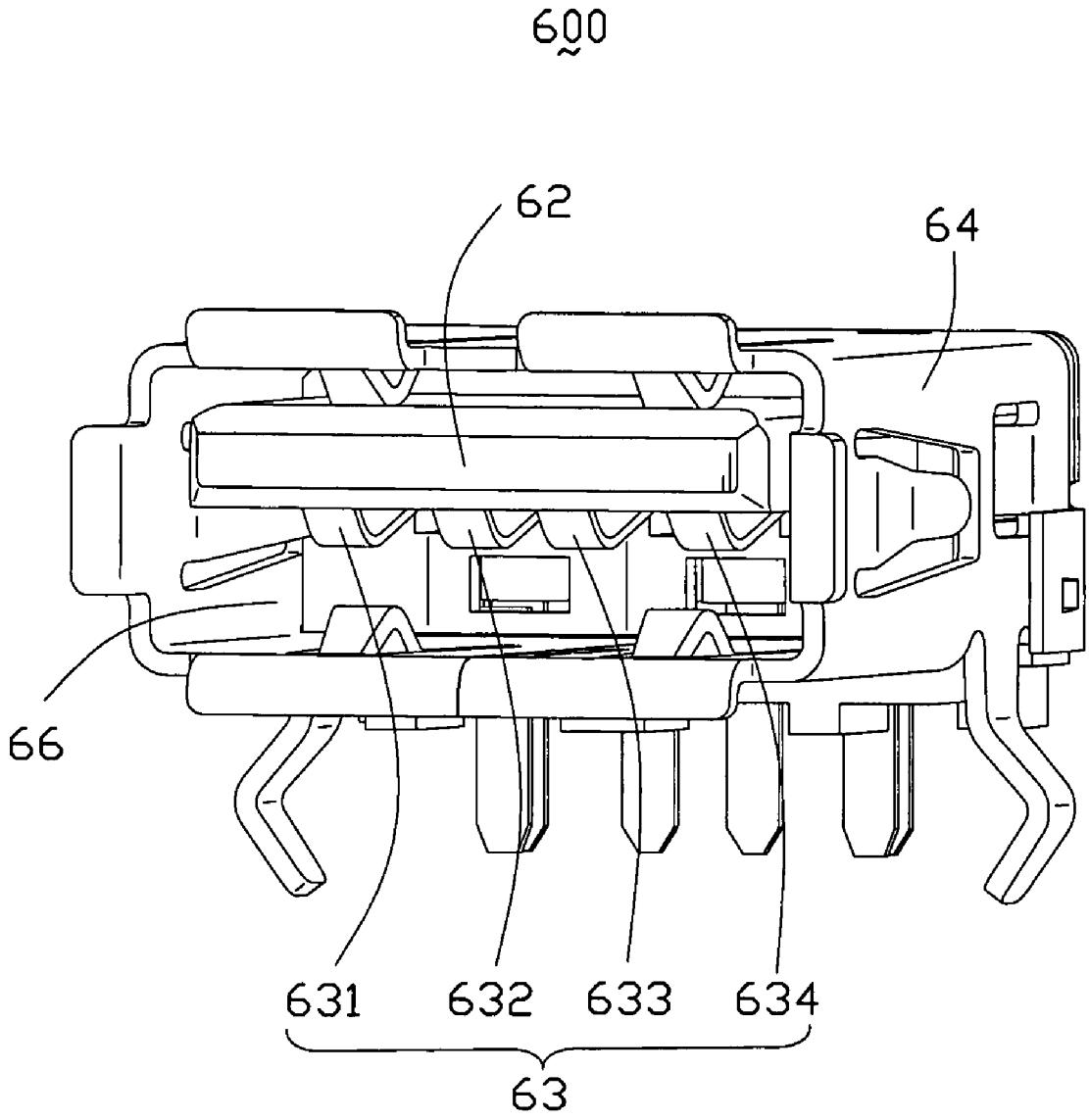
FIG. 23 (PRIOR ART)
FIG. 23 is a perspective view of an existing standard USB receptacle.

The extension to USB receptacle 200 is compatible to existing standard USB receptacle, such as the standard USB receptacle 600 in FIG. 23. An arrangement of the four receptacle conductive contacts 231, 232, 233 and 234 is compatible to what of the standard USB receptacle 600. The four receptacle conductive contacts are for USB protocol to transmit USB signals. The conductive contact 231, 232, 233 and 234 are for-power (VBUS) signal, – data signal, + data signal and grounding, respectively. So now, from assignment of each receptacle conductive contacts standpoint, different terminology are given to each of the four receptacle conductive contacts 23, the conductive contacts 231, 232, 233 and 234 respectively named as power contact 231, – data contact 232, + data contact 233 and ground contact 234.

The geometric profile of the receptacle tongue portion 22 is same to what of the standard USB plug 600 within an allowable tolerance, that is, length, width and height of the receptacle tongue portion 22 are substantially equal to what of the standard USB receptacle 600. The supporting side 221 of the receptacle tongue portion 12 is a bottom side thereof. Locations of the four receptacle conductive contacts 231, 232, 233 and 234 on the receptacle tongue portion 22 are same to what of the extension to USB plug 100 described above. So detailed description about the locations of the four receptacle conductive contacts 231, 232, 233 and 234 on the receptacle tongue portion 22 is omitted here.

Figure 6:
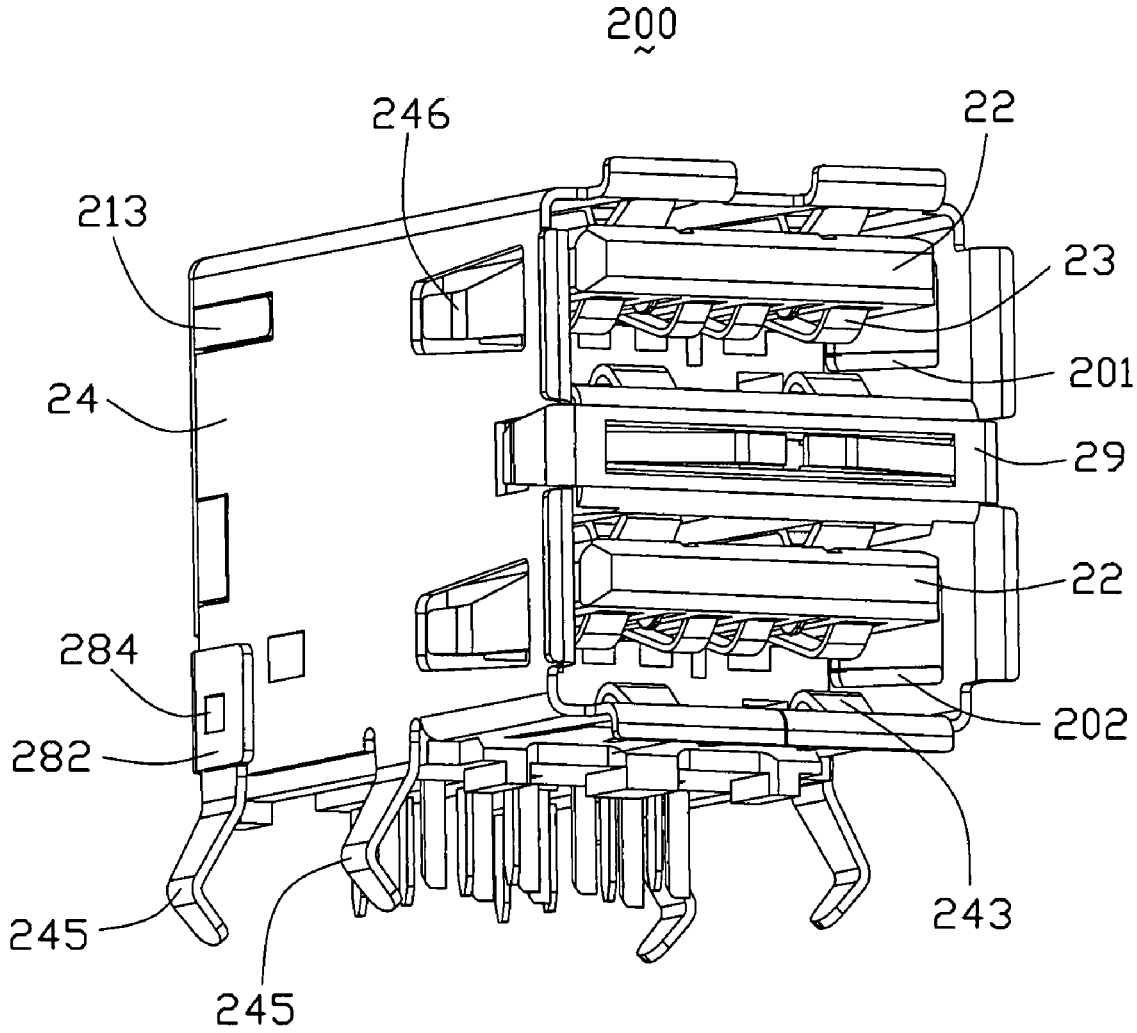
FIG. 6 is a perspective view of an extension to USB receptacle.

Regarding FIGS. 6-8, the receptacle metal shell 24 is in a tube shape, which defines a top side 242, a bottom side 241 opposite to the top side 242 and a pair of sidewalls 249 connecting the top side 242 and the bottom side 241. The receptacle metal shell 24 is mounted to the receptacle base portion 21 to cover the receptacle base portion 21, the plug receptacle portion 22 and the receptacle contacts 23 with a receiving cavity 202 formed between the supporting side 221 of the below receptacle and the bottom side 241. Each of the top and bottom side 242, 241 and the pair of sidewalls 249 is formed with a pair of spring arms 243, 246. The top side 141 also forms a tab 248 projecting inwardly to engage with the receptacle base portion 21 and a pair of through holes 247 near a rear end thereof. The pair of sidewalls 249 forms with a plurality of depressed portions 248 near the rear end thereof and a plurality of projections 244 protruding inwardly to engage with corresponding projections 213 and depressed portions 214 of the receptacle base portion 21. Thus, the receptacle metal shell 24 is secured on the receptacle base portion 21 firmly.

The another metal shell 29 includes a front wall 290, a pair of sidewall 292 extending rearward from right and left edge of the front wall 290 and a pair of top and bottom walls 294 extending rearward from top and bottom edge of the front wall 290. The front wall 292 forms a pair of spring arms 291 stamped out therefrom. The top and bottom walls 294 each also forms a pair of sparing arms 293 stamped out therefrom and a pair of engaging portions for pressed into the receptacle base portion 21. The another metal shell 29 is mounted to the supporting plate 25 from a front side of the receptacle housing 20. A top receiving cavity 201 of the top receptacle is formed between the supporting side 221 of the top receptacle and the top wall 294 of another metal shell 29. A below receiving cavity 202 of the below receptacle is formed between the supporting side 221 of the below receptacle and the bottom side 241 of receptacle metal shell 24. The receptacle contacting portions 26 are all exposed to the receiving cavity 201, 202 to contact corresponding contacting portions of a complementary connector. An arrangement of the receiving cavity 201/202 and the receptacle tongue portion 22 are also compatible with what of standard USB receptacle 500.

As fully described above, the extension to USB plug 100 and the extension to USB receptacle 200 both are compatible to the standard USB connector. In application, the extension to USB plug 100 is capable of mating with the standard USB receptacle 600 and the extension to USB receptacle 200, alternatively. The extension to USB receptacle 200 is capable of mating with the standard USB receptacle 600 and the extension to USB receptacle 200, alternatively.

In FIGS. 12-15, a mating status of the extension to USB plug 100 fully insertion into the extension to USB receptacle 200 is shown. After the extension to USB plug 100 is fully inserted into the extension to USB receptacle 200, all plug contacts 13 physically contact corresponding receptacle contacts 23 as clearly shown in FIGS. 14-15. In conjunction with FIGS. 2-3, when both or either one of the extension to USB plug 100 and the extension to USB receptacle 200 is under USB protocol, this connector system transmit USB signals. In this case, only the four conductive plug contacts 131, 132, 133 and 134 electrically contact with corresponding receptacle contacts 231, 232, 233 and 234; while the two pairs of differential plug contacts 135, 137, 136 and 138 make no electrical contact with corresponding differential receptacle contacts 235, 237, 236 and 238. When both of the extension to USB plug 100 and the extension to USB receptacle 200 are under a non-USB protocol, this connector system transmit non-USB signals. In this case, all of the plug contacts 13 electrically contact with corresponding all receptacle contacts 23. Meanwhile, the spring arms 243 of the receptacle metal shell 24 engage with corresponding through holes 143 of the plug shell 14 and other spring arms 246 of the receptacle metal shell 24 engage with sidewalls 146 of the plug shell 14 to secure the mating state and shielding effect of the metal shells 14 and 24. Under the USB protocol, the – data contact 132 (232), + data contact 133 (233) together transmit and receive data to and from an electrical device; while when the extension to USB plug and the extension to USB receptacle is under the non-USB protocol, the two pairs of differential contacts transfer differential signals unidirectionally, one pair for receiving data, another for transmission data, which is a different assignment from what of the – data contact 132 (232), + data contact 133 (233).

Figure 16:
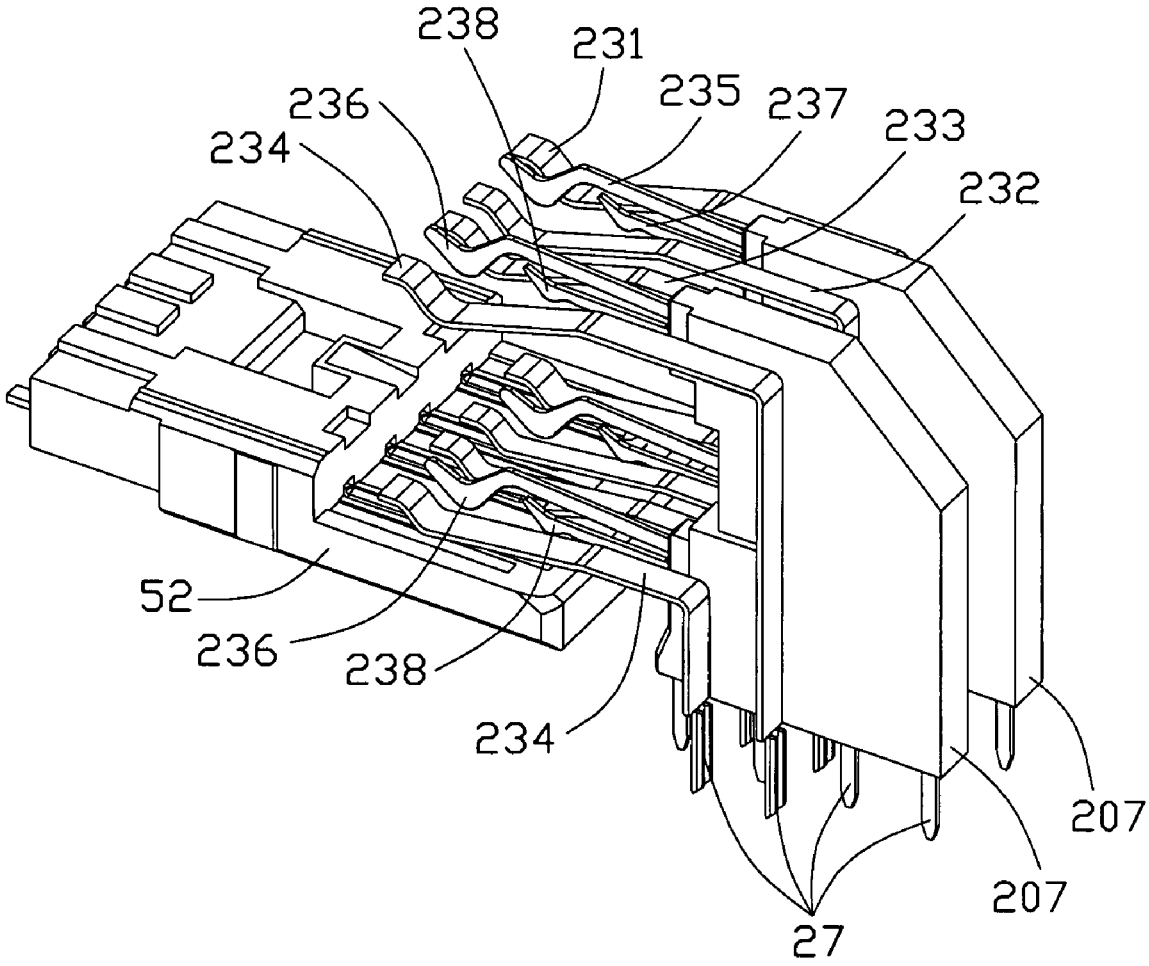
FIG. 16 is a perspective view of the standard USB plug and the extension to USB receptacle in a mating status with their metal shells taken off, illustrating mating relations of the contacts of the standard USB plug and the extension to USB receptacle.
Figure 17:
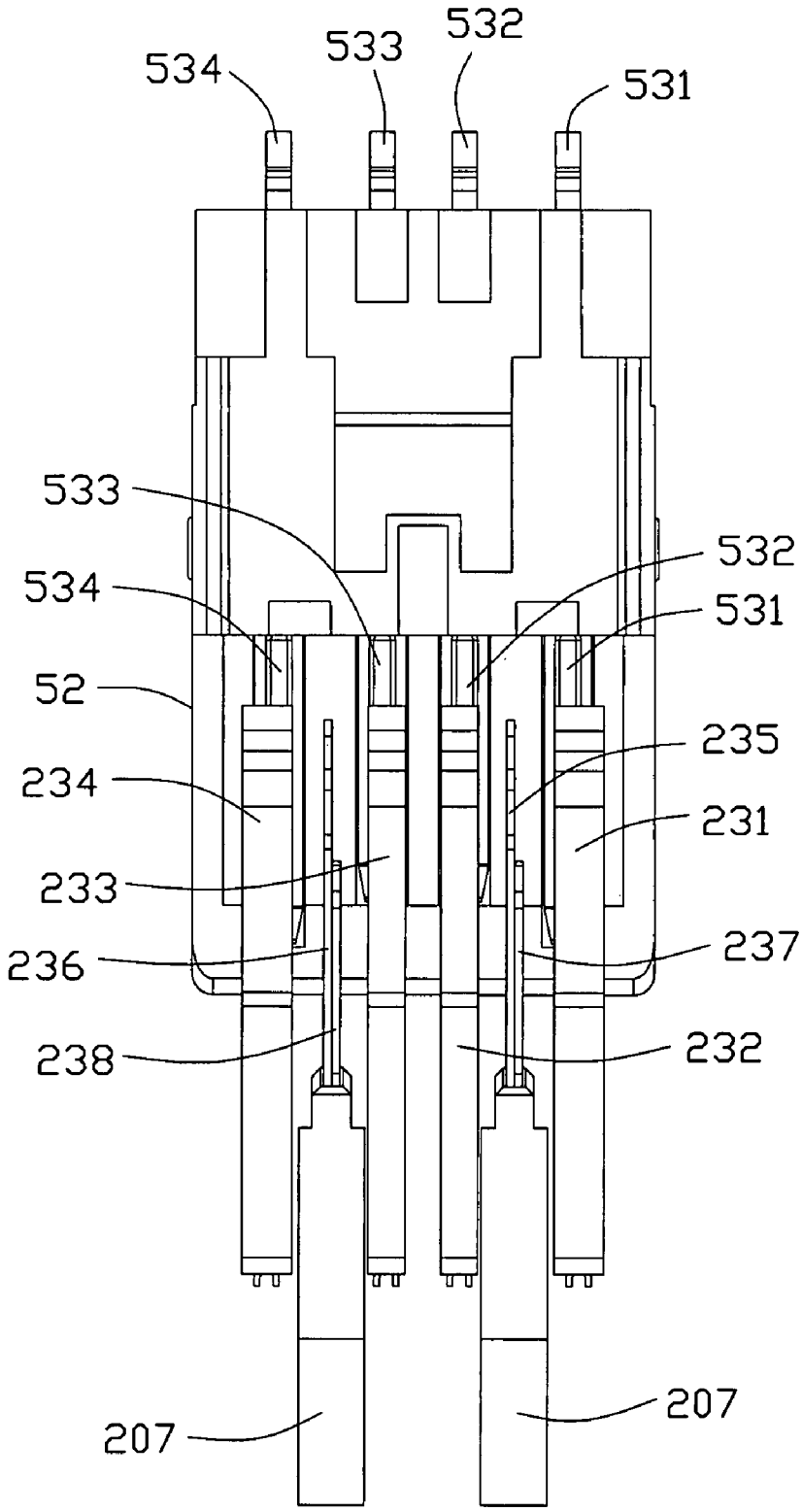
FIG. 17 is a top plane view of the standard USB plug and the extension to USB receptacle in the mating status shown in FIG. 16, further illustrating the mating relations of the contacts of the standard USB plug and the extension to USB receptacle.

Regarding FIGS. 16-17, a mating status of the standard USB plug 500 fully insertion into the extension to USB receptacle 200 is shown. To clarify relationships of their contacts, their metal shells 54 and 24 are taken off. After the standard USB plug 500 is fully inserted into the extension to USB receptacle 200, all contacts 53 physically contact corresponding receptacle contacts 231, 232, 233 and 234 as clearly shown in FIGS. 16-17 to transmit USB signals. The differential receptacle contacts 235, 237, 236 and 238 of the extension to USB receptacle 200 make no electrical connection with any part of the standard USB plug 500.

Figure 18:
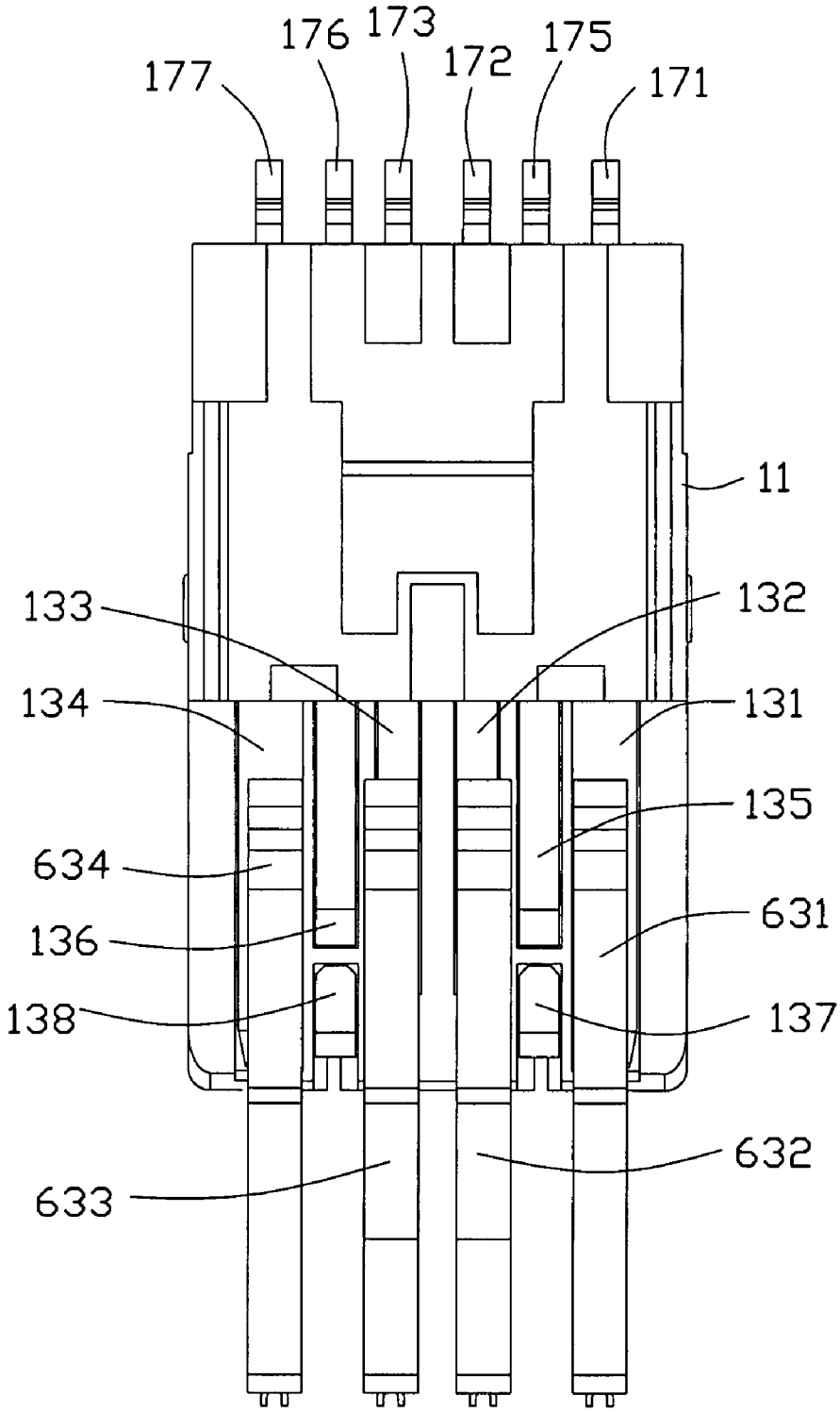
FIG. 18 is a top plane view of the extension to USB plug and a standard USB receptacle in a mating status, illustrating a mating relations of the contacts of the extension to USB plug and a standard USB receptacle.

Regarding FIG. 18, a mating status of the extension to USB plug 100 fully insertion into the standard USB receptacle 600 is shown. To clarify relationships of their contacts, their metal shells 14 and 64 are taken off. After the extension to USB plug 100 is fully inserted into the standard USB receptacle 600, all contacts 63 physically contact corresponding plug contacts 131, 132, 133 and 134 to transmit USB signals. The differential plug contacts 135, 137, 136 and 138 of the extension to USB plug 100 make no electrical connection with any part of the standard USB receptacle 600.

Figure 19:
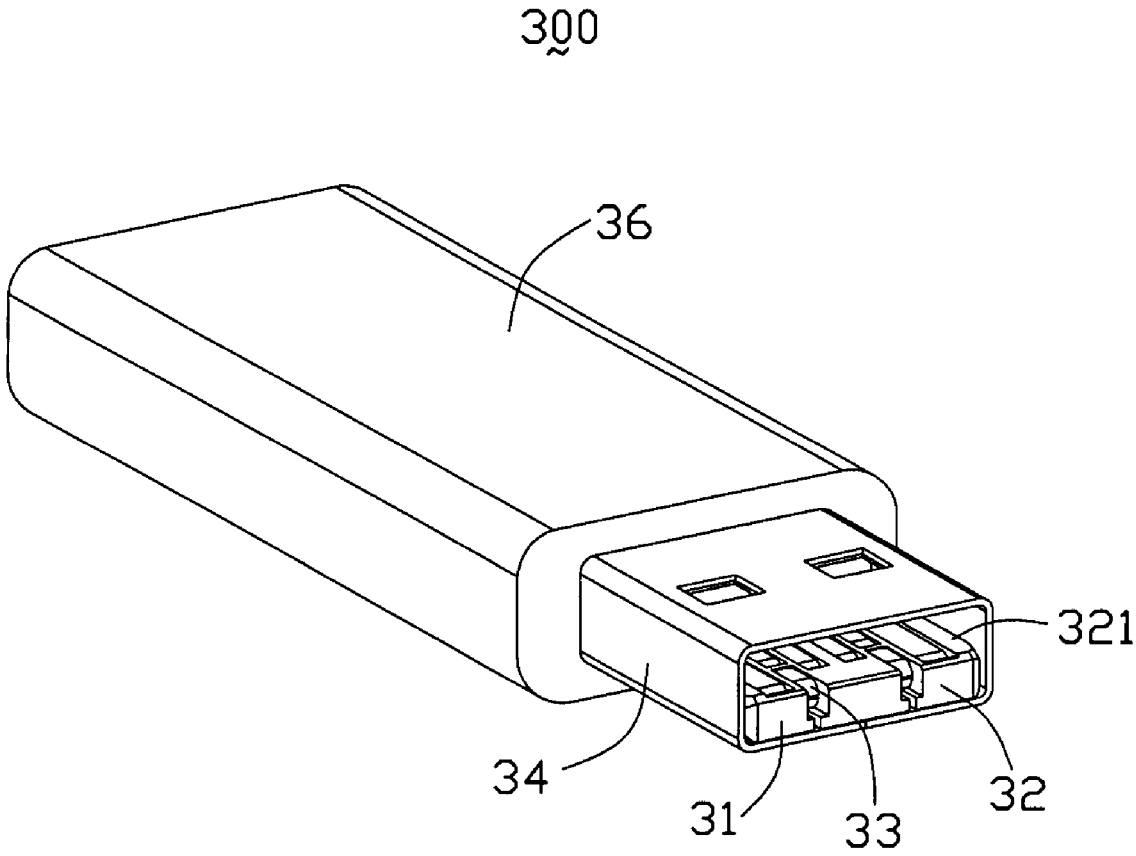
FIG. 19 is a perspective view of an extension to USB plug according to a second embodiment of present invention.

A second embodiment of the present invention is disclosed in FIG. 19. In this embodiment, the extension to USB is a memory device 300. The memory device 300 includes an outer case 36 enclosing a printed circuited board with a memory unit (not shown) and an interface 31 electrically connecting with the printed circuit board. The interface 31 includes a tongue portion 32, a plurality of contacts 33 supported on a supporting side 321 of the tongue portion 32. The tongue portion 32 and the contacts 33 are both with an arrangement same to what of the extension to USB plug 100 shown in FIG. 1, which is compatible to what of the standard USB connector. Besides, assignments of all contacts 33 are also same to what of the extension to USB plug 100. Therefore, detailed description about the tongue portion 32 and the contacts 33 are omitted here. In this embodiment, tail portions (not shown in FIG. 19, but can referred to FIG. 4) of the contacts 33 are physically and electrically connected to the printed circuit board. In addition, in this embodiment, a metal shell 34 is provided to enclose the tongue portion 32 and the contacts 33. An arrangement between the metal shell 34 and the tongue portion 32 is also same to what of the extension to USB plug 100. The memory device 300 is capable of mating with either of the standard USB receptacle 600 or the extension to USB receptacle 200 shown in FIG. 6.

Figure 20:
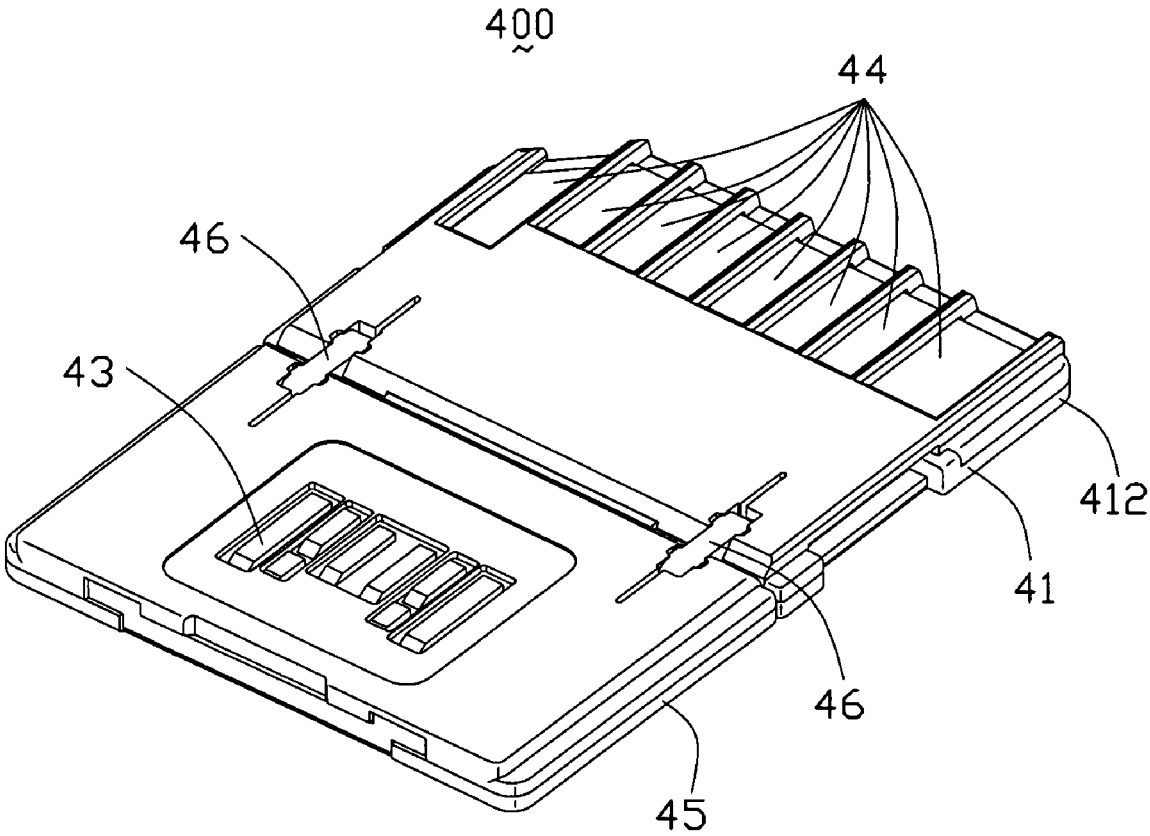
FIG. 20 is a perspective view of an extension to USB plug according to a third embodiment of the present invention, which including a set of contacts with a contact pattern following a memory card standard.
Figure 21:
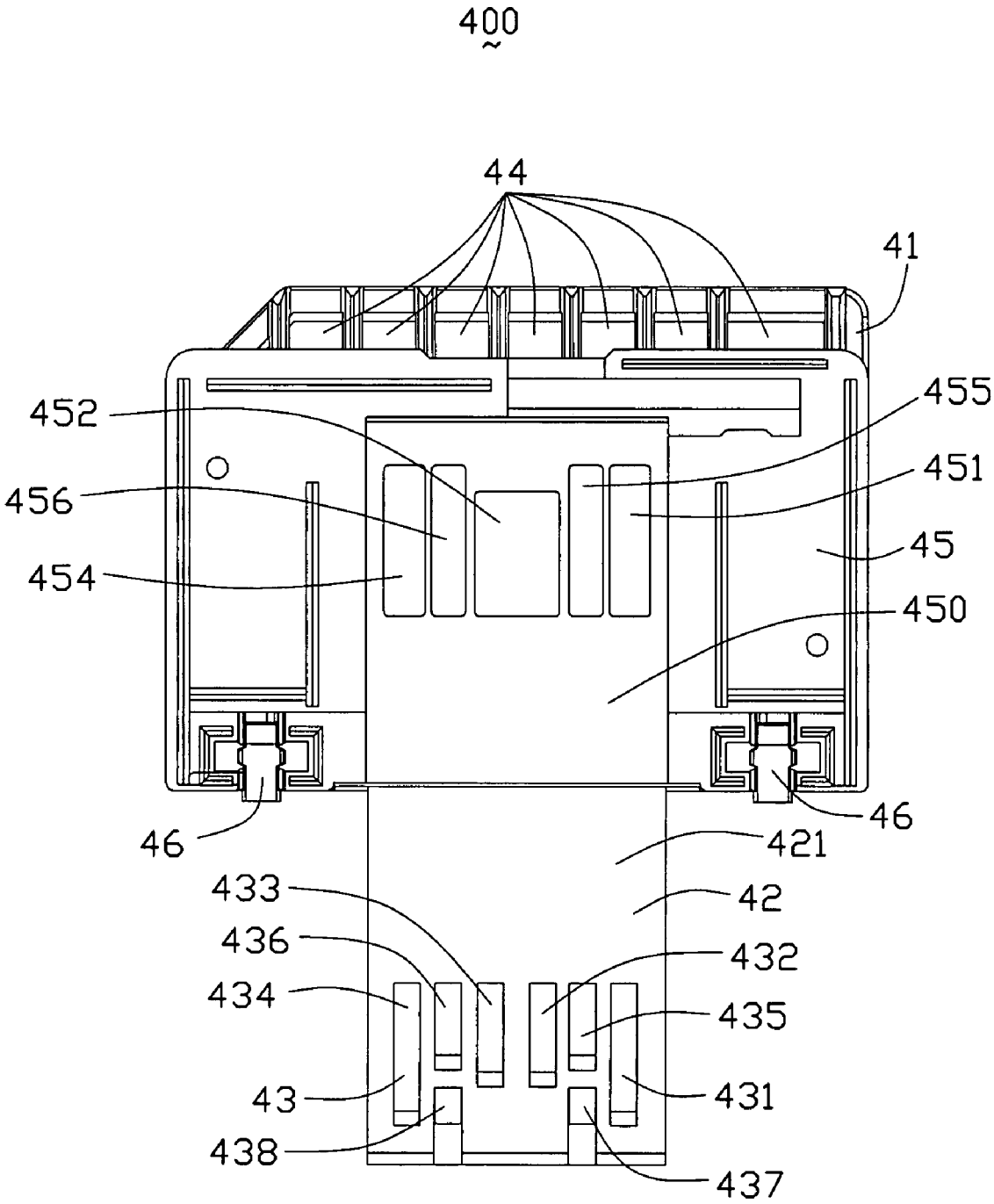
FIG. 21 is another perspective view of the extension to USB plug shown in FIG. 20, illustrating that a cover thereof is opened to expose a number of contacts with a contact arrangement compatible to the standard USB plug.

A third embodiment of the present invention is disclosed in FIGS. 20-21. In this embodiment, the extension to USB is a memory card 400. The memory card 400 is a SD card device. The memory card 400 includes an insulative board portion 41, a set of electrical contacts 44 located at a free end 412 of the insulative board portion 41, a cover portion 45 pivotally connecting with the insulative board portion 41 via a pair of hinges 44, an insulative tong portion 42 associating with the insulative board portion 41 and another set of contacts 43 supported on a supporting side 421 of the insulative tongue portion 42. The set of electrical contacts 44 is arranged in a contact pattern following the SD card standard to transmit signal protocol of the SD card standard.

The cover portion 45 defines a plurality of openings 450 to accommodate the contacts 43. The contacts 43 includes four conductive contacts designated with numeral 431, 432, 433 and 434 and two pairs of differential contacts designated with numeral 435, 437 and 436, 438. The pair of differential contacts 435, 437 is located between the conductive contacts 434 and 432 without disturbing any one of the conductive contacts 431 and 432. The other pair of the differential contacts 436, 438 is located between the conductive contacts 433 and 434 without disturbing any one of the plug conductive contacts 433 and 434. An arrangement of the four conductive contacts 431, 432, 433 and 434 is compatible to what of the standard USB plug 500. The four conductive contacts are for USB protocol to transmit USB signals. The conductive contact 431, 432, 433 and 434 are for power (VBUS) signal, – data signal, + data signal and grounding, respectively.

In this embodiment, the cover portion 45 defines a plurality of through holes 451, 452, 453, 454, 455 and 456 to receiving the contacts 43 therein. The cover portion 45 is rotatable between a first position and a second portion. When the cover portion 45 at its first position, as shown in FIG. 20, the tongue portion 42 is covered by the cover portion 45 and an external profile and dimension of cover portion together with the insulative board portion 41 follows the SD card standard. When the cover portion 45 is opened to its second position, as shown in FIG. 21, the tongue portion 42 and the contacts 43 are all fully exposed. The tongue portion 42 is compatible to the tongue portion 52 of the standard USB plug. A width and height of the tongue portion 42 are substantially equal to what of the tongue portion 52 of the standard USB plug 500 within an allowable tolerance. A length of the tongue portion 42 is equal to or longer than what of the tongue portion 52 of the standard USB plug 500.

In use, when the cover portion 45 is fully opened to its seconded position, the tongue potion 42 is fully exposed and then the memory card 400 also is capable of mating with either of the standard USB receptacle 600 or the extension to USB receptacle 200 shown in FIG. 6 to transfer/receive data to/from the memory card 400 to a device equipped with a standard USB receptacle 600 or an extension to USB receptacle 200. When the cover portion 45 is fully closed to its first position, then the memory card 400 is capable of mating with an existing memory card connector to transfer/receive data to/from the memory card 400 to a device equipped with the memory card connector.

In the third embodiment, the cover portion 45 is pivotally connecting with the insulative board portion 41 via the pair of hinges 46. It is understood that the cover portion 45 can be detachable connected with the insulative board portion 41. When the cover portion 45 is connected with insulative board portion 41, the memory card is in a shape as shown in FIG. 20 following a specification of SD card. When the cover portion 45 is detached from with insulative board portion 41(not shown), the tongue potion 42 is fully exposed and then the memory card 400 also is capable of mating with either of the standard USB receptacle 600 or the extension to USB receptacle 200. In this embodiment, the contacts 44 and contacts 43 being at a same side of the memory card 400, understandably, to locate the contacts 44 and contacts 43 at reverse side of the memory card 400 is another option which is an obvious change. In this embodiment, the memory card is a SD card. Obviously, other memory card, such as CF card, MMC card, MS card et al, is also viable under a similar principle of the third embodiment. Theses changes are all obvious for an ordinal skill person in this field.

With contrast to the standard USB connector (standard USB plug and standard USB receptacle), the additional two pairs of differential contacts in the extension to USB plug 100 and the extension to USB receptacle 200 provide a high transfer data for an electrical connector system with the extension to the extension to USB plug 100 and the extension to USB receptacle 200 in operation. Take the extension to USB plug 100 for example, the arrangement of power contact 131, the – data contact 132, the + data contact 133 and the ground contact 134 is compatible to what of a standard USB plug. This means that the extension to USB plug 100 can be applied in any field that the standard USB plug is applied. The pair of differential contacts 135 and 137 is located between the power contact 131 and the – data contact 132 and the other pair of differential contacts 136 and 138 is located between the + data contact 133 and the ground contact 134. With such arrangement, the extension to USB plug 100 is with an ease structure and is portable. Furthermore, as the two pairs of differential contacts is used for an non-USB protocol, now, the extension to USB plug also can applied in other electronic device supporting the non-USB protocol. The extension to USB can also be a memory device and a memory card to be applied in many electronic devices. The apply field of the extension to USB (the extension to USB plug and the extension to USB receptacle) are extended and meanwhile it provide a high transfer rate, which is desirable to industries and end user, nowadays.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An extension to universal serial bus (USB) 2.0 revision for transmitting signals from and to a host device, comprising:

a receiving cavity for accommodating a complementary mating electrical connector;

an insulative tongue portion residing in the receiving cavity, the insulative tongue portion defining a front-to-rear direction, a rear end at a rear of the insulative tongue portion and a supporting side at one side of the insulative tongue portion;

a plurality of contacts held in the insulative tongue portion with all contacting portions located at the supporting side and further exposed to the receiving cavity, the contacts comprising four conductive contacts and two pairs of differential contacts for transferring differential signals, the four conductive contacts consisting of a power contact, a ground contact, a – data contact and a + data contact, one pair of the differential contacts located in a gap formed by the adjacent power contact and the – data contact, the other pair of the differential contacts located in another gap formed by the adjacent power contact and the + data contact; and wherein the four conductive contacts are for USB 2.0 revision protocol and arrangement of the four conductive contacts is compatible to a standard USB connector; and wherein the two pairs of differential contacts are for a non-USB 2.0 revision protocol.

2. The extension to USB as claimed in claim 1, wherein a geometric profile of the insulative tongue portion is substantially same as what of the standard USB connector.

3. The extension to USB as claimed in claim 1, wherein one contact of each pair of the two pairs of differential contacts is separated from the other in the front-to-rear direction.

4. The extension to USB as claimed in claim 3, wherein one contact of each pair of the two pairs of differential contacts offsets from the other laterally from the front-to-rear direction.

5. The extension to USB as claimed in claim 1, wherein the contacts comprise tail portions opposite to the contacting portions, the contacting portions contacting with corresponding contacting portions of the complementary mating electrical connector, free ends of the tail portions connecting with an electrical element.

6. The extension to USB as claimed in claim 5, wherein the contacting portions of each pair of the two pairs of differential contacts is substantially in a line in the front-to-rear direction.

7. The extension to USB as claimed in claim 6, wherein one contact of each pair of the two pairs of differential contacts is inserted into the insulative tongue portion from a front end thereof, the tail portions of the contacts inserted from the front end being parallel with and located below the contacting portions thereof.

8. The extension to USB as claimed in claim 7, wherein the tail portions of the contacts inserted from the front end are apart from the tail portions of other contacts in both the front-to-rear direction and a lateral direction perpendicular to the front-to-rear direction.

9. The extension to USB as claimed in claim 5, further comprising a case for gripping by a user, wherein the electrical element is a printed circuit board with a memory unit, the printed circuit board being enclosed within the case.

10. The extension to USB as claimed in claim 5, further comprising an insulative base portion with the insulative tongue portion integrally extending forwardly therefrom in the front-to-rear direction and a metal shell secured on the insulative base portion, the metal shell enclosing the insulative base portion, the insulative tongue portion and the contacts, the receiving cavity being formed between the supporting side and a side of the metal shell, wherein arrangement of the receiving cavity and the four conductive contacts is compatible to the standard USB connector.

11. The extension to USB as claimed in claim 10, further comprising at least an insulating element to have the two pairs of differential contacts partly inserted therein, the insulating element being mounted to the insulative base portion from a rear side thereof with the contacting portions of the two pairs of differential contacts extending into the receiving cavity and the tail portions of the two pairs of differential contacts extending beyond the insulative base section.

12. An electrical connector system compatible to standard USB 2.0 revision connector, comprising:

an insulative tongue portion, the insulative tongue portion defining a front-to-rear direction and a supporting side extending in the front-to-rear direction;

a plurality of contacts held in the supporting side, the contacts comprising four conductive contacts and two pairs of differential contacts for transferring differential signals, the four conductive contacts consisting of a power contact, a ground contact, a – data contact and a + data contact, pitches between the power contact and the – data contact, the ground contact and the + data contact being larger than what of the standard USB connector to accommodate the two pairs of the differential contacts therebetween, respectively; and wherein the four conductive contacts are for USB 2.0 revision protocol and a arrangement of the four conductive contacts is compatible to the standard USB 2.0 revision connector; and wherein the two pairs of differential contacts are for a non-USB 2.0 revision protocol; and further comprising an insulative base portion with the insulative tongue portion extending forwardly therefrom in the front-to-rear direction and a metal shell secured on the insulative base portion, the metal shell enclosing the insulative base portion, the insulative tongue portion and the contacts, a receiving cavity being formed between the supporting side and a side of the metal shell and exposed exterior at a front end of the insulative tongue portion, wherein each of the contacts comprises a contacting portion and a tail portion, the contacting portions being exposed to the receiving cavity to contact corresponding contacting portion of a complementary mating electrical connector, and wherein arrangement of the receiving cavity and the four conductive contacts is compatible to the standard USB 2.0 revision connector.

13. The electrical connector system as claimed in claim 12, wherein the insulative tongue portion defines a reverse side opposite to the supporting side, a pair of lengthwise slots is defined in the reverse side to make at least one contact of each pair of the differential contacts exposed exterior in a direction perpendicular to the reverse side.

14. The electrical connector system as claimed in claim 12, wherein a geometric profile of the insulative tongue portion is substantially same as what of the standard USB 2.0 revision connector.

15. The electrical connector system as claimed in claim 12, wherein the supporting tongue portion defines a center line extending in the front-to-rear direction, distances between the center line and the power contact, and between the center line and the ground contact being larger than what of the standard USB 2.0 revision connector.

16. The electrical connector system as claimed in claim 15, wherein widths of the power contact and the ground contact are same as what of corresponding contacts of the standard USB 2.0 revision connector

17. The electrical connector system as claimed in claim 12, wherein widths of the – data contact and the + data contact are narrower than what of corresponding contacts of the standard USB 2.0 revision connector,

18. The electrical connector system as claimed in claim 12, wherein the insulative tongue portion integrally extends forwardly from the insulative base portion.

19. The electrical connector system as claimed in claim 12, further comprising a rear metal shell enclosing a rear side of the insulative base portion, the rear metal shell being locked with the metal shell at the rear end thereof.

20. The electrical connector system as claimed in claim 12, wherein at least two of the insulative tongue portions extending integrally forwardly from the insulative base portion, one of the insulative tongue portion being above the other, a supporting plate being provide between the two of insulative tongue portions in a manner extending integrally forwardly therefrom, the receiving cavity formed between the supporting side and the side of the metal shell being located below and another receiving cavity formed between a top side of the supporting plate and the supporting side of the insulative tongue portion above being located above.

21. The electrical connector system as claimed in claim 20, further comprising another metal shell enclosing the supporting plate, the receiving cavity located above being above a top side of the another metal shell, and wherein the receiving cavities and the arrangement of the contacts exposed to the receiving cavities are compatible to standard male USB connectors.

22. An electrical connector comprising:

an insulative base portion and an insulative tongue portion extending forwardly from the insulative base portion along a rear-to-front direction;

a metal shell secured on the insulative base portion and enclosing the insulative tongue portion in order to jointly form a mating port for receiving a complementary connector;

a set of resilient type contacts including a power contact, a – data contact, a + data contact and a ground contact arranged in turn along a lateral direction perpendicular to the rear-to-front direction; and first and second pairs of differential contacts disposed in the insulative base portion; wherein all the resilient type contacts and the first and second pairs of differential contacts include resilient contacting portions located at the same side of the insulative tongue portion and further protruding into the mating port; and wherein the first pair of differential contacts include first and second differential contacts arranged along the rear-to-front direction and disposed at a gap formed by the adjacent power contact and the – data contact; similarly, the second pair of differential contacts include third and fourth differential contacts arranged along the rear-to-front direction and disposed at another gap formed by the adjacent ground contact and the + data contact.

23. The connector as claimed in claim 22, wherein the first and the second pairs of differential contacts are assembled to the insulative base portion from the rear-to-front direction.

24. The connector as claimed in claim 23, wherein insulating elements are molded over the first and the second pairs of differential contacts, respectively, for easily assembly the first and the second pairs of differential contacts to the insulative base portion.

25. The connector as claimed in claim 22, wherein the insulative tongue portion defining a plurality of passageways for the resilient contacting portions deformable therein.

26. The connector as claimed in claim 22, wherein the first and second differential contacts are aligned with each other along the rear-to-front direction, the gap formed by the adjacent power contact and the – data contact being much larger than that of the standard USB 2.0 revision connector in order to easily mount the first and second differential contacts; similarly, the third and fourth differential contacts are aligned with each other along the rear-to-front direction, the another gap formed by the adjacent ground contact and the + data contact being much larger than that of the standard USB 2.0 revision connector in order to easily mount the third and fourth differential contacts.

* * * * *